US011134554B2

(12) United States Patent
Li et al.

(10) Patent No.: US 11,134,554 B2
(45) Date of Patent: Sep. 28, 2021

(54) CONTROL METHOD FOR COMBINED LAMP, AND ILLUMINATION SYSTEM

(71) Applicant: OPPLE LIGHTING CO., LTD., Shanghai (CN)

(72) Inventors: Zhijun Li, Shanghai (CN); Jun Wu, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/911,135

(22) Filed: Jun. 24, 2020

(65) Prior Publication Data

US 2020/0329545 A1 Oct. 15, 2020

Related U.S. Application Data

(63) Continuation of application No. PCT/CN2018/122884, filed on Dec. 21, 2018.

(30) Foreign Application Priority Data

Dec. 29, 2017 (CN) ..... 201711480923.1
Dec. 29, 2017 (CN) ..... 201721923704.1

(51) Int. Cl.
*G09G 5/00* (2006.01)
*H05B 47/18* (2020.01)
(Continued)

(52) U.S. Cl.
CPC ..... *H05B 47/18* (2020.01); *H05B 45/325* (2020.01); *H05B 45/00* (2020.01)

(58) Field of Classification Search
CPC ..... H05B 45/325; H05B 47/18
See application file for complete search history.

(56) References Cited

U.S. PATENT DOCUMENTS 7,355,562 B2 * 4/2008 Schubert ..... G09F 9/3026 345/1.3
8,922,458 B2 * 12/2014 Sefton ..... G06F 3/1446 345/1.3
(Continued)

FOREIGN PATENT DOCUMENTS

CN 102217415 A 10/2011
CN 202907302 U 4/2013
(Continued)

OTHER PUBLICATIONS

International Search Report of PCT Application No. PCT/CN2018/122884 dated Mar. 1, 2019, (4p).

*Primary Examiner* — Kurtis R Bahr
(74) *Attorney, Agent, or Firm* — Arch & Lake LLP

(57) ABSTRACT

The present disclosure provides a method for controlling a combined lamp, a lighting system and an electronic device, and the method includes connecting a main controller to any lamp unit of the combined lamp, taking a lamp unit which is physically connected to the main controller as a reference, configuring address information for lamp units of the combined lamp according to a preset algorithm strategy and according to a connection relationship between the lamp units of the combined lamp. The main controller carries the address information parsed from a control instruction in the control signal and sends the control signal to the combined lamp, and enables a lamp unit, which is matched with the address information in the control signal, to utilize the control signal to control a light-emitting state of the lamp unit.

20 Claims, 7 Drawing Sheets

(51) Int. Cl.
*H05B 45/325* (2020.01)
*H05B 45/00* (2020.01)

(56) References Cited

U.S. PATENT DOCUMENTS

| | | | | |
|---|---|---|---|---|
| 9,081,265 | B2 | 7/2015 | Spaulding et al. | |
| 9,311,847 | B2 * | 4/2016 | Hall | G09G 3/3208 |
| 9,801,243 | B2 * | 10/2017 | Sauerlander | H05B 47/185 |
| 2011/0115413 | A1 * | 5/2011 | Erickson | H05B 47/155 315/312 |
| 2011/0210674 | A1 * | 9/2011 | Melanson | H05B 45/375 315/185 R |
| 2013/0313973 | A1 * | 11/2013 | DeNicholas | H05B 45/48 315/122 |
| 2014/0103810 | A1 | 4/2014 | Shaffer, II et al. | |
| 2017/0198868 | A1 * | 7/2017 | Scapa | F21S 10/023 |

FOREIGN PATENT DOCUMENTS

| | | | |
|---|---|---|---|
| CN | 104871647 | A | 8/2015 |
| CN | 108064110 | A | 5/2018 |

* cited by examiner

CONTROL METHOD FOR COMBINED LAMP, AND ILLUMINATION SYSTEM

CROSS-REFERENCE TO RELATED APPLICATIONS

This application is based upon and claims the priority of PCT patent application No. PCT/CN2018/122884 filed on Dec. 21, 2018 which claims priority to the Chinese patent application No. 201711480923.1 filed on Dec. 29, 2017 and the Chinese patent application No. 201721923704.1 filed on Dec. 29, 2017, the entire content of all of which is hereby incorporated by reference herein for all purposes.

TECHNICAL FIELD

The present disclosure relates to the technical field of lighting, in particular to a method for controlling a combined lamp, and a lighting system.

BACKGROUND

With the rapid development of Internet of Things and intelligent control technology, various intelligent lighting products have sprung up. Although the lighting lamps can meet the daily lighting needs of most people, some control forms of the lighting products may be too simple. For example, some lamps can be only presented as a single product, that is, only one lamp is connected to a control circuit.

SUMMARY

The present disclosure provides a method for controlling a combined lamp, a lighting system and an electronic device.

According to an aspect of the present disclosure, a method for controlling a combined lamp is provided, the method may be applied to a main controller for controlling the combined lamp to emit light, the combined lamp may include at least two lamp units that are connected to each other in sequence, the main controller may be physically connected to any lamp unit of the combined lamp.

The method may include: taking a lamp unit, which is physically connected to the main controller, as a reference, configuring address information for lamp units of the combined lamp according to a preset algorithm strategy and according to a connection relationship between the lamp units of the combined lamp; receiving a control instruction that controls a light-emitting state of the combined lamp and carries at least one address information, and parsing out the at least one address information carried in the control instruction; and generating a control signal corresponding the control instruction according to the control instruction, carrying the at least one address information that is obtained by parsing in the control signal and sending the control signal to the combined lamp, and enabling a lamp unit, which is matched with the at least one address information in the control signal, to utilize the control signal to control a light-emitting state of the lamp unit, which is matched with the at least one address information in the control signal.

According to another aspect of the present disclosure, a lighting system is provided, and the lighting system may include a main controller and a combined lamp. The combined lamp may include at least two lamp units that are connected to each other. The main controller may be physically connected to any lamp unit of the combined lamp, and comprises an address configuration circuit, a parsing circuit, and a control circuit.

The address configuration circuit may be configured to: take a lamp unit that is physically connected to the main controller as a reference, and configure address information for lamp units of the combined lamp according to a preset algorithm strategy and according to a connection relationship between the lamp units of the combined lamp.

The parsing circuit may be configured to receive a control instruction that controls a light-emitting state of the combined lamp and carries at least one address information, and parse out the at least one address information carried in the control instruction.

The control circuit may be configured to generate a control signal corresponding the control instruction according to the control instruction, carry the at least one address information that is obtained by parsing in the control signal and sent the control signal to the combined lamp, and enable a lamp unit, which is matched with the at least one address information in the control signal, to utilize the control signal to control a light-emitting state of the lamp unit, which is matched with the at least one address information in the control signal.

According to a further aspect of the present disclosure, an electronic device is provided. The device may include a processor; and a memory configured to store computer executable instructions. In a case where the computer executable instructions are executed, the executable instructions enable the processor to: connect at least two lamp units of a combined lamp; connect a main controller to any lamp unit of the combined lamp, wherein the main controller comprises an address configuration circuit, a parsing circuit, and a control circuit; take a lamp unit that is physically connected to the main controller as a reference, configure address information for lamp units of the combined lamp according to a preset algorithm strategy and according to a connection relationship between the lamp units of the combined lamp; receive a control instruction that controls a light-emitting state of the combined lamp and carries at least one address information, and parse out the at least one address information carried in the control instruction; and generate a control signal corresponding the control instruction according to the control instruction, carry the at least one address information that is obtained by parsing in the control signal and sending the control signal to the combined lamp, and enable a lamp unit, which is matched with the at least one address information in the control signal, to utilize the control signal to control a light-emitting state of the lamp unit, which is matched with the at least one address information in the control signal.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure, and the drawings constitute a part of the present disclosure. The schematic examples of the present disclosure and the descriptions thereof are used for explaining the present disclosure, and thus do not constitute an improper limitation on the present disclosure. In the drawings.

DETAILED DESCRIPTION

The technical solutions of the present disclosure are described in a clearly and fully understandable way in connection with the examples and the drawings related to the examples of the present disclosure. The described examples are just a part but not all of the examples of the present disclosure. Based on the examples of the present disclosure, those skilled in the art may obtain other example (s), without any inventive work, which should be within the protection scope of the present disclosure The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

This connection method for lighting lamps may be difficult to achieve the effect of complex lighting coordination change of a plurality of combination lamps. Therefore, how to connect a plurality of lamps to a single control circuit and implement any combination and precise positioning control of lamps at the same time has become a technical problem to be solved.

Figure 1:
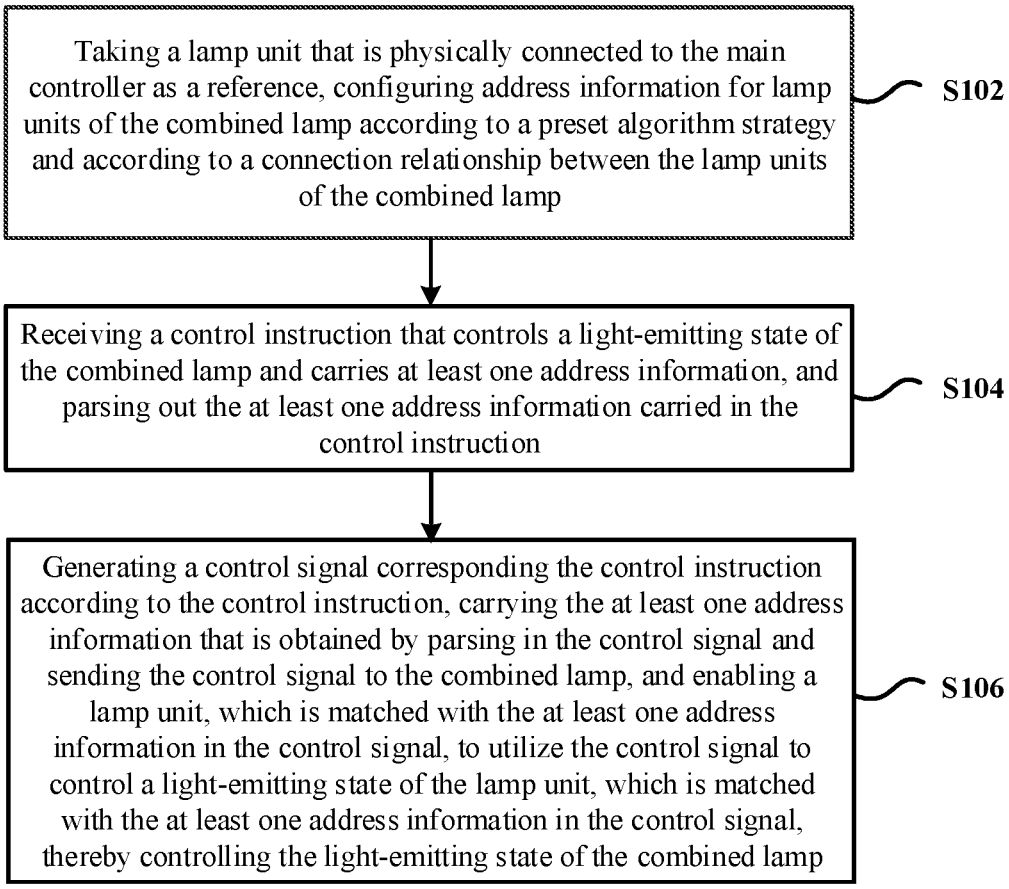
FIG. 1 illustrates a schematic flow chart of a method for controlling a combined lamp according to an example of the present disclosure.

In order to solve this technical problem, the examples of the present disclosure provide a method for controlling a combined lamp. The method is applied to a main controller for controlling the combined lamp to emit light, the combined lamp includes at least two lamp units that are connected to each other in sequence, and the main controller is physically connected to any lamp unit of the combined lamp. FIG. 1 illustrates a schematic flow chart of a method for controlling a combined lamp according to an example of the present disclosure. Referring to FIG. 1, the method includes at least steps S102 to step S106.

Step S102: taking a lamp unit that is physically connected to the main controller as a reference, configuring address information for lamp units of the combined lamp according to a preset algorithm strategy and according to a connection relationship between the lamp units of the combined lamp.

Figure 2A:
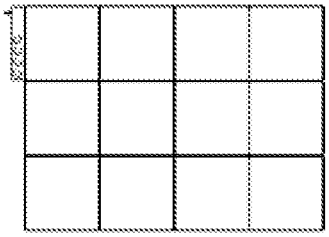
FIG. 2A illustrates a schematic structural diagram of a combined lamp according to an example of the present disclosure.
Figure 2B:
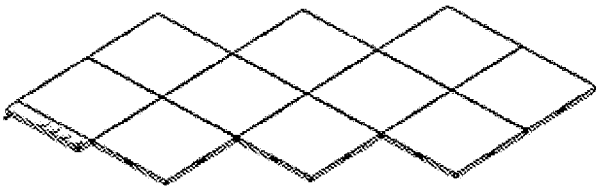
FIG. 2B illustrates a schematic structural diagram of a combined lamp according to another example of the present disclosure.

In the step S102, each lamp unit in the combined lamp may be of any shape, and combined lamps having different shapes may be obtained by splicing lamp units in different ways. The number of the lamp units of the combined lamp may also be any number greater than 2, which is not limited in the examples of the present disclosure. For example, the combined lamp in FIG. 2A has 12 lamp units, the shape of each lamp unit is a plate cube shape, and the combined lamp that is spliced is a cuboid. The combined lamp in FIG. 2B has 10 lamp units, the shape of each lamp unit is a plate cube shape, and the combined lamp that is spliced is an irregular cube.

Step S104: receiving a control instruction that controls a light-emitting state of the combined lamp and carries at least one address information, and parsing out the at least one address information carried in the control instruction.

In the step S104, if the main controller has a control panel, the main controller can directly receive the information for controlling the light-emitting state of the combined lamp and the address information of the lamp unit, which is controlled, that are set by the user through the control panel. If the main controller does not have a control panel, but the main controller has a communication function to establish a communication connection with an external device (not illustrated in the figures), then the main controller can receive the control instruction, which controls the light-emitting state of the combined lamp and carries at least one address information, from the external device. The examples of the present disclosure do not limit the way in which the main controller receives the control instruction. The following descriptions introduce how to configure unique address information for each lamp unit.

Step S106: generating a control signal corresponding the control instruction according to the control instruction, carrying the at least one address information that is obtained by parsing in the control signal and sending the control signal to the combined lamp, and enabling a lamp unit, which is matched with the at least one address information in the control signal, to utilize the control signal to control a light-emitting state of the lamp unit, which is matched with the at least one address information in the control signal, thereby controlling the light-emitting state of the combined lamp.

In the step S106, for example, if there are 3 lamp units in the combined lamp, and the combined lamp is currently in a non-illuminated state, one lamp unit of the lamp units may be controlled to emit light by the control signal, or two lamp units of the lamp units may be controlled to emit light by the control signal, or all three lamp units of the lamp units may be controlled to emit light by the control signal, and the brightness and color temperature of any lamp unit that is emitting light can also be controlled by the control signal. The introduction of the light emitting effect of the combined lamp is only schematic, and the examples of the present disclosure are not limited thereto.

The examples of the present disclosure, compared with the case where one controller is connected to only one lamp unit in other implementations, can effectively implement the precise positioning of any lamp unit of the combined lamp, thereby implementing the light emitting control of the any lamp unit according to the positioning of the lamp units, and further implementing the complex coordinating change effect of the lamp units.

Referring to the step S102 above, in an example of the present disclosure, in the process of configuring the address information for the lamp units of the combined lamp, in order to more conveniently configure the address information for the lamp units, a reference lamp unit may be selected from the lamp units first. For example, first, the lamp unit, which is physically connected to the main controller, is identified from the combined lamp, and the lamp unit is taken as a central node. Then, by taking the lamp unit that is taken as the central node as a reference, the address information for the lamp units of the combined lamp are configured according to the preset algorithm strategy and according to the connection relationship between the lamp units of the combined lamp. The address information may be represented by a 1-byte binary integer, may also be represented by a decimal number or other number, which is not limited here.

Continuing to refer to the step S102 above, in an example of the present disclosure, each lamp unit may be provided with at least two IO interfaces, and two adjacent lamp units are physically connected to each other through an IO control line that is connected between two IO interfaces of the two adjacent lamp units. Correspondingly, the main controller has at least one IO interface, and the main controller is physically connected to any lamp unit through an IO control line that is connected between an IO interface of the main controller and an IO interface of the any lamp unit. That is, IO control lines are respectively connected between the main controller and all IO interfaces of a lamp unit, and the IO control lines are independent of each other, individually controlled, and not connected to each other. The IO control line is mainly used to identify the location of the IO interface and the next-stage lamp unit that is connected to the IO control line.

Figure 3:
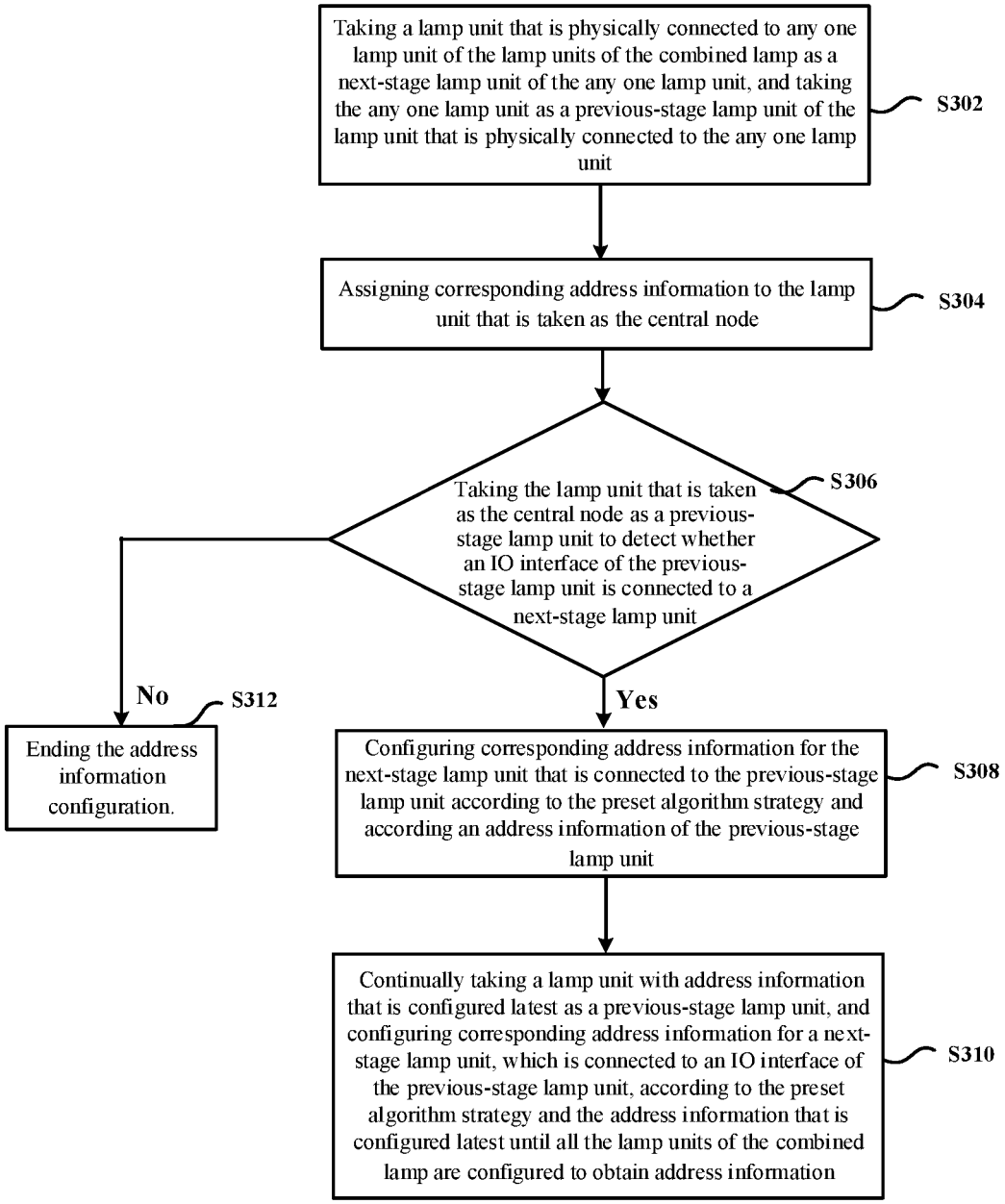
FIG. 3 illustrates a schematic diagram of an address configuration process of a combined lamp according to an example of the present disclosure.

Thus, according to the main controller and an IO interface on a lamp unit, the address of the lamp unit that is connected to the IO interface can be configured. The address configuration process is illustrated in FIG. 3, and the process includes steps S302 to S310.

Step S302: taking a lamp unit that is physically connected to any one lamp unit of the lamp units of the combined lamp as a next-stage lamp unit of the any one lamp unit, and taking the any one lamp unit as a previous-stage lamp unit of the lamp unit that is physically connected to the any one lamp unit. For example, in the combined lamp illustrated in FIG. 4, a lamp A is the previous-stage lamp unit of lamps B, C, and D, and a lamp B is the previous-stage lamp unit of a lamp E.

Figure 4:
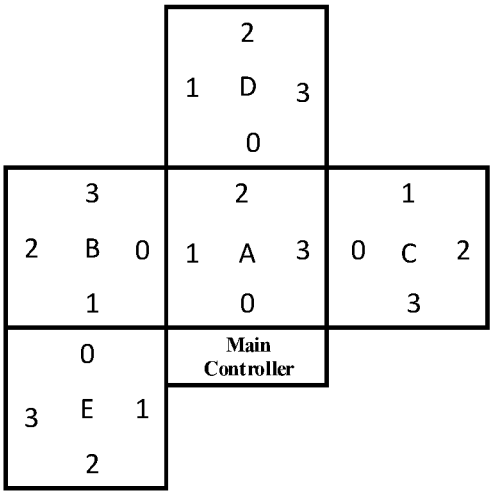
FIG. 4 illustrates a schematic structural diagram showing a case that a controller is connected to a combined lamp according to an example of the present disclosure.

Step S304: assigning corresponding address information to the lamp unit that is taken as the central node. Referring to FIG. 4, because the lamp A is connected to the main controller, the lamp A in FIG. 4 is a lamp unit that is taken as the central node.

Step S306: taking the lamp unit that is taken as the central node as a previous-stage lamp unit to detect whether an IO interface of the previous-stage lamp unit is connected to a next-stage lamp unit. in a case where the IO interface of the previous-stage lamp unit is connected to the next-stage lamp unit, performing step S308, and in case of no, performing step S312 and ending the address information configuration.

Step S308: configuring corresponding address information for the next-stage lamp unit that is connected to the previous-stage lamp unit according to the preset algorithm strategy and according an address information of the previous-stage lamp unit, and continually performing step S310.

Step S310: continually taking a lamp unit with address information that is configured latest as a previous-stage lamp unit, and configuring corresponding address information for a next-stage lamp unit, which is connected to an IO interface of the previous-stage lamp unit, according to the preset algorithm strategy and the address information that is configured latest until all the lamp units of the combined lamp are configured to obtain address information.

For example, in the example illustrated in FIG. 4, the lamp B is the lamp unit with address information that is configured latest, then, in this case, the lamp B may be taken as the previous-stage lamp unit. Because the IO interface 1 of the lamp B is also connected to the lamp E, the lamp E is the next-stage lamp unit of the lamp B, and the corresponding address information is configured for the lamp E according to the preset algorithm strategy and according the address information of the lamp B. If any IO interface of the lamp E is further connected to other lamp unit, then by analogy, the corresponding address information is configured for a next-stage lamp unit, which is connected to the any IO interface of the lamp E, according to the preset algorithm strategy and according the address information of the lamp E, until all the lamp units of the combined lamp are configured to obtain the address information.

Referring to the step S310 above, the examples of the present disclosure may adopt the following preset algorithm strategy to configure the corresponding address information for the lamp units.

First, a coordinate system is established for the combined lamp, and the coordinate value of the central node is configured according to the coordinate system that is established. For example, a rectangular coordinate system is established for the combined lamp, and the coordinate value configured for the central node in the rectangular coordinate system is (128, 128).

Then, each lamp unit of the combined lamp is taken as a node, the central node is taken as a previous-stage node, an IO interface, which is connected to a next-stage node, of the previous-stage node is acquired, and a coordinate axial direction of the IO interface is determined. Each lamp unit is taken as a node, that is, each lamp unit occupies a coordinate position in the rectangular coordinate system. In the example, the coordinate axial direction refers to the direction of an IO interface of a lamp unit, relative to the central node, on each coordinate axis (for example, the x-axis and the y-axis) in the coordinate system.

Furthermore, the node type and the node direction of the next-stage node are determined according to the coordinate axial direction of the IO interface, which is connected to the next-stage node, of the previous-stage node, and the coordinate value of the next-stage node is determined by combining with the coordinate value of the previous-stage node, the node type of the next-stage node, and the node direction of the next-stage node.

The node types of the examples of the present disclosure may include three types, that is, a central node, a normal node, and a turning point. In addition, the definition principle of the node types is as follows: the lamp unit, which is physically connected to the main controller, is the central node, in the rectangular coordinate system, the node, the ordinate of which changes with respect to the central node, is the turning point, and the other nodes are the normal nodes.

For the node direction, the example is defined as taking the central node as the reference point, the node obtained by splicing left along the reference point is a x-axis negative direction node, the node obtained by splicing right along the reference point is a x-axis positive direction node, the node obtained by splicing down along the reference point is a y-axis negative direction node, and the node obtained by splicing up along the reference point is a y-axis positive direction node.

Finally, a node with a coordinate value that is determined latest is continually taken as a previous-stage node, a node type and a node direction of a next-stage node, which is connected to the previous-stage node, is determined according to a coordinate axial direction of an IO interface, which is connected to the next-stage node, of the previous-stage node, and the coordinate value of the next-stage node is determined in combination with the coordinate value that is determined latest until coordinate values of nodes corresponding to all the lamp units of the combined lamp are determined.

In order to more conveniently determine the node type and the node direction of the next-stage node according to the IO interface of the previous-stage node, the corresponding interface numbers can be set for the IO interfaces of any node. Further, the interface number of the IO interface, which is connected to the next-stage node, of the previous-stage node is acquired to determine the coordinate axial direction of the IO interface corresponding to the interface number, and to determine the node type and the node direction of the next-stage node. For example, an example of the present disclosure provides a rule for numbering the interface numbers as follows: first, the interface number of an IO interface, which is connected to the previous-stage node, of the any node is set as No. 0 IO interface. Then, the corresponding interface numbers of IO interfaces other than the No. 0 IO interface are set sequentially by a manner of increasing numbers in a clockwise direction. For example, if the lamp unit has 4 IO interfaces, the 4 IO interfaces are set to 0, 1, 2, and 3 sequentially in the clockwise direction. If the lamp unit has 3 IO interfaces, the 3 IO interfaces are set to 0, 1, and 2 sequentially in the clockwise direction. In addition, the numbering sequence of the IO interfaces may further be used as the configuration sequence for configuring the addresses of the lamp units connected to the IO interfaces. The examples of the present disclosure do not limit the number and numbering sequence of the IO interfaces of the lamp unit. In the present example, the main controller is taken as the previous-stage node of the central node. In the present example, in the case of setting the numbers for the IO interfaces of the lamp unit, the numbers may also be set in a counterclockwise direction or in other ways, which is not limited in the examples of the present disclosure.

It can be seen from the above that the node type and the node direction of the next-stage node are determined by taking the node with the latest coordinate value as the previous-stage node and combining with the coordinate axial direction of the IO interface, which is connected to the next-stage node, of the previous-stage node. In fact, the node type and the node direction of the next-stage node are closely related to the IO interface, which is connected to the next-stage node, of the previous-stage node. Therefore, taking FIG. 4 as an example and combining the node type and the node direction in the above, the IO interfaces, which are numbered, of the nodes are introduced.

In the combined lamp illustrated in FIG. 4, the lamp A is the central node. In this case, interface 1 (the interface mentioned here and later is the IO interface) is a negative direction normal node interface, interface 2 is a positive direction turning point interface, and interface 3 is a positive direction normal node interface.

Interface 1 of the lamp B is a negative direction turning point interface, interface 2 of the lamp B is a negative direction normal node interface, and interface 3 of the lamp B is a positive direction turning point interface.

Interface 1 of the lamp C is a positive direction turning point interface, interface 2 of the lamp C is a positive direction normal node interface, and interface 3 of the lamp C is a negative direction turning point interface.

Interface 1 of the lamp D is a negative direction normal node interface, interface 2 of the lamp D is a positive direction turning point interface, and interface 3 of the lamp D is a positive direction normal node interface.

Interface 1 of the lamp E is a positive direction normal node interface, interface 2 of the lamp E is a negative direction turning point interface, and interface 3 of the lamp E is a negative direction normal node interface.

In an example of the present disclosure, the node type and the node direction have been briefly introduced above. In the process of configuring the corresponding address information for the lamp units in the combined lamp by using the preset algorithm strategy, the method of determining the node type and the node direction of the next-stage node according to the coordinate axial direction of the IO interface, which is connected to the next-stage node, of the previous-stage node is introduced.

In the present example, the coordinate system that is established is set to a rectangular coordinate system, and the coordinate axes of the rectangular coordinate system are the x-axis and the y-axis, respectively. In the case where the coordinate axial direction of the IO interface, which is connected to the next-stage node, of the previous-stage node is a positive direction of the x-axis, then the next-stage node that is connected to the IO interface is a positive direction normal node. The node type of the next-stage node is a normal node, and the node direction of the next-stage node is the positive direction of the x-axis.

In the case where the coordinate axial direction of the IO interface, which is connected to the next-stage node, of the previous-stage node is a negative direction of the x-axis, then the next-stage node that is connected to the IO interface is a negative direction normal node. The node type of the next-stage node is a normal node, and the node direction of the next-stage node is the negative direction of the x-axis.

In the case where the coordinate axial direction of the IO interface, which is connected to the next-stage node, of the previous-stage node is a positive direction of the y-axis, then the next-stage node that is connected to the IO interface is a positive direction turning point. The node type of the next-stage node is a turning point, and the node direction of the next-stage node is the positive direction of the y-axis.

In the case where the coordinate axial direction of the IO interface, which is connected to the next-stage node, of the previous-stage node is a negative direction of the y-axis, then the next-stage node that is connected to the IO interface is a negative direction turning point. The node type of the next-stage node is a turning point, and the node direction of the next-stage node is the negative direction of the y-axis.

Furthermore, after the node type and the node direction of the next-stage node are determined, the coordinate value of the next-stage node is also be determined by combining with the coordinate value of the previous-stage node, the node type of the next-stage node, and the node direction of the next-stage node, and the process is as follows.

The coordinate value of the previous-stage node is set as (a, b). The coordinate value of the next-stage node is determined to be (a+n, b) in the case where the next-stage node that is connected to the previous-stage node is the positive direction normal node. The coordinate value of the next-stage node is determined to be (a−n, b) in the case where the next-stage node that is connected to the previous-stage node is the negative direction normal node. The coordinate value of the next-stage node is determined to be (a, b+n) in the case where the next-stage node that is connected to the previous-stage node is the positive direction turning point. The coordinate value of the next-stage node is determined to be (a, b−n) in the case where the next-stage node that is connected to the previous-stage node is the negative direction turning point, and n is a positive integer.

In order to more clearly embody the examples of the present disclosure, taking FIG. 4 as an example, the process of configuring the addresses for the lamp units of the combined lamp by the main controller of the present disclosure is introduced.

Step 1: the main controller identifies a lamp A physically connected to the main controller (that is, the lamp unit A), sets the lamp A as the central node, and configures the coordinate value of the central node to be (128, 128), that is, the x-axis coordinate value and the y-axis coordinate value are both 128. In addition, the interface number of the IO interface, which is connected to the main controller, of the lamp A is set as 0, and the other IO interfaces of the lamp A are 1, 2, and 3 in the clockwise direction.

Step 2: the main controller detects the connection status of each IO interface of the lamp A, and detects that each of the IO interfaces 1, 2, and 3 is connected to a next-stage lamp unit.

Step 3: based on the coordinate value of the lamp A and the coordinate axial directions of the three IO interfaces, the main controller configures different coordinate values for the next-stage lamps B, C, D (that is, the lamp units B, C, D) connected to the lamp A, respectively, according to the preset algorithm strategy. Thus, the coordinate value of the lamp B is (127, 128), the coordinate value of the lamp C is (129, 128), and the coordinate value of the lamp D is (128, 129). In addition, the main controller sets the numbers as shown in FIG. 4 for respective IO interfaces of the lamps B, C and D.

Step 4: the main controller moves the current detection node to the next node, that is, the lamp B, detects the connection status of each IO interface of the lamp B, and detects that a lamp unit E is connected to the IO interface 1 of the lamp B. Furthermore, in the same way, based on the coordinate value of the lamp B and the coordinate axial directions of the three IO interfaces of the lamp B, the coordinate value of the lamp unit E is set to be (127, 127) according to the method in step 3 above.

Step 5: the main controller moves the current detection node to the next node, that is, the lamp unit E, detects the connection status of each IO interface of the lamp unit E, and does not detect the case that there is a next-stage lamp unit connected to the lamp unit E.

Step 6: the main controller moves the current detection node to the next node, that is, the lamp unit C, detects the connection status of each IO interface of the lamp unit C, and does not detect the case that there is a next-stage lamp unit connected to the lamp unit C.

Step 7: the main controller moves the current detection node to the next node, that is, the lamp unit D, detects the connection status of each IO interface of the lamp unit D, and does not detect the case that there is a next-stage lamp unit connected to the lamp unit D. So far, the main controller completes to configure the coordinate values for the lamp units of the combined lamp, that is, the address information configuration for the lamp units are completed.

After the main controller completes to configure the address information for the lamp units, the example of the present disclosure may adopt the mechanism of the master-slave communication protocol to control the light-emitting state of the lamp units by the main controller, the main controller is the master device and the combined lamp is the slave device. In each communication process, the master device initiates a communication request and the slave device responds to the master device's request.

In the case where the main controller receives the control instruction that controls the light-emitting state of the combined lamp and carries at least one address information, the main controller parses out the at least one address information carried in the control instruction. In addition, the main controller can further generate the control signal corresponding the control instruction according to the control instruction, carry the at least one address information that is obtained by parsing in the control signal and send the control signal to the combined lamp, and then each lamp unit of the combined lamp matches the address information in the control signal with its own address information, and the lamp unit, the address information of which is successfully matched with the at least one address information in the control signal, can utilize the control signal to control the light-emitting state of the lamp unit, thereby controlling the light-emitting state of the combined lamp.

Taking FIG. 4 as an example, in the case where the address information that is carried in the control instruction is the coordinate value (128, 128), after the main controller carries the coordinate value (128, 128) in the control signal generated by the main controller and sends the control signal to the combined lamp, the lamp unit A finds that the coordinate value in the control signal matches its own coordinate value after matching the coordinate value with its own coordinate value, and can obtain the control signal and utilize the control signal to control itself to emit light.

In the present example, the main controller sequentially communicates with the lamp units through a communication bus. After the main controller generates the control signal corresponding the control instruction according to the control instruction, the main controller can carry the address information that is obtained by parsing in the control signal and send the control signal to the lamp units of the combined lamp through the communication bus. In addition, in the above examples, in a case where the main controller identifies the IO interfaces of the respective lamp units through the IO control lines, and then configures the address information for the lamp units that are connected to the IO interfaces, the address information may also be transmitted to the lamp unit through the communication bus, the address information that is configured is stored by the lamp unit, and is subsequently matched with the address information in the control signal.

In an example of the present disclosure, it has been mentioned above that if the main controller does not have a control panel, but the main controller has a communication function to establish a communication connection with an external device, then the main controller can receive the control instruction, which controls the light-emitting state of the combined lamp and carries at least one address information, from the external device, and then the main controller parses out the address information from the control instruction. In the present example, the external device may be a hand-held device, such as a smart phone that is installed with an APP capable of communicating with the combined lamp, or a terminal device, and so on. The external device is connected to the main controller in a wired or wireless manner.

In the present example, in the case where the external device adopts a smart phone, and the smart phone is installed with an APP capable of communicating with the combined lamp. Then, after the main controller completes to configure the address information (for example, the coordinate values) for the lamp units, a schematic image of the combined lamp may be also formed on the interface of the APP according to the positions of the lamp units, and the coordinate values of the lamp units are marked on the image, which is convenient for the user to intuitively select the lamp unit to be controlled through the display interface of the smart phone.

In an example of the present disclosure, in the case where a new lamp unit is added to the combined lamp or an existing lamp unit is removed from the combined lamp, the address information of lamp units in the adjusted combined lamp (that is, the current combined lamp) is updated according to the address configuration manner of the foregoing example, and accordingly, the schematic image of the combined lamp in the interface of the APP is updated.

In the above examples, the communication bus used for communication between the main controller and the lamp units is a communication bus set up to achieve the transmission of the control signal, and in the art, the transmission of the power supply signal between the main controller and the lamp units of the combined lamp adopts a power line, that is, the transmission of the communication signal and the transmission of the power supply signal between the main controller and the lamp units of the combined lamp need to adopt different lines. In order to save line resources, the example of the present disclosure can also implement the signal communication between the main controller and the combined lamp by multiplexing the power line, that is, the power line in the example of the present disclosure can transmit both the communication signal and the power supply signal. For example, the main controller and at least two lamp units of the combined lamp are all electrically connected to the same power line. After the main controller parses out at least one address information that is carried in the control instruction and generates the control signal corresponding the control instruction according to the control instruction, the address information that is obtained by parsing is carried in the control signal, and the control signal is superimposed on the power line and sent to the combined lamp.

Figure 5:
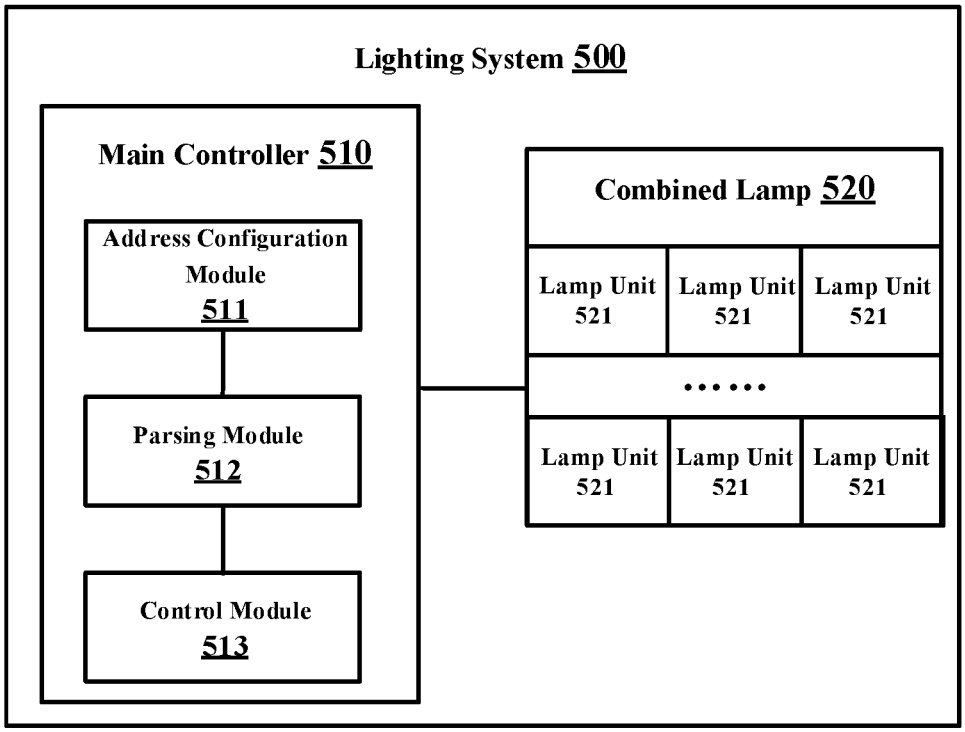
FIG. 5 illustrates a schematic structural diagram of a lighting system according to an example of the present disclosure.

Based on the same inventive concept, an example of the present disclosure further provides a lighting system, FIG. 5 illustrates a schematic structural diagram of a lighting system according to an example of the present disclosure. Referring to FIG. 5, the lighting system 500 includes a main controller 510 and a combined lamp 520, and the combined lamp 520 includes at least two lamp units 521 that are connected to each other in sequence. The main controller 510 is physically connected to any lamp unit 521 of the combined lamp 520, and the main controller 510 includes an address configuration module 511, a parsing module 512, and a control module 513.

The address configuration module 511 is configured to: take a lamp unit that is physically connected to the main controller 510 as a reference, and configure address information for the lamp units 521 of the combined lamp 520 according to a preset algorithm strategy and according to a connection relationship between the lamp units 521 of the combined lamp 520.

The parsing module 512 is coupled to the address configuration module 511, and is configured to receive a control instruction that controls a light-emitting state of the combined lamp and carries at least one address information, and parse out the at least one address information carried in the control instruction.

The control module 513 is coupled to the parsing module 512, and is configured to generate a control signal corresponding the control instruction according to the control instruction, carry the at least one address information that is obtained by parsing in the control signal and sent the control signal to the combined lamp, and enable a lamp unit, which is matched with the at least one address information in the control signal, to utilize the control signal to control the light-emitting state of the lamp unit, which is matched with the at least one address information in the control signal, thereby controlling the light-emitting state of the combined lamp. The control signal includes the signal that controls any lamp unit to emit light or to be turned off, and/or the signal that performs dimming control and/or color adjustment control on any lamp unit, and the type of the control signal includes a digital signal type.

In an example of the present disclosure, the control module 513 is further configured to generate the control signal corresponding the control instruction according to the control instruction, carry the address information that is obtained by parsing in the control signal, and send the control signal to the combined lamp based on a customized transmission protocol.

In the present example, the main controller 510 sequentially communicates with the lamp units 521 through a communication bus, and then in a case where the main controller 510 generates the control signal corresponding the control instruction according to the control instruction and transmits the control signal, the main controller can carry the address information that is obtained by parsing in the control signal and send the control signal to the lamp units 521 of the combined lamp 520 through the communication bus. Furthermore, the lamp unit 521 matches the address information in the control signal with own address information of the lamp unit 521, and utilizes the control signal to control own light-emitting state of the lamp unit in the case where the address information in the control signal is successfully matched with the address information of the lamp unit 521, thereby controlling the light-emitting state of the combined lamp.

Figure 6:
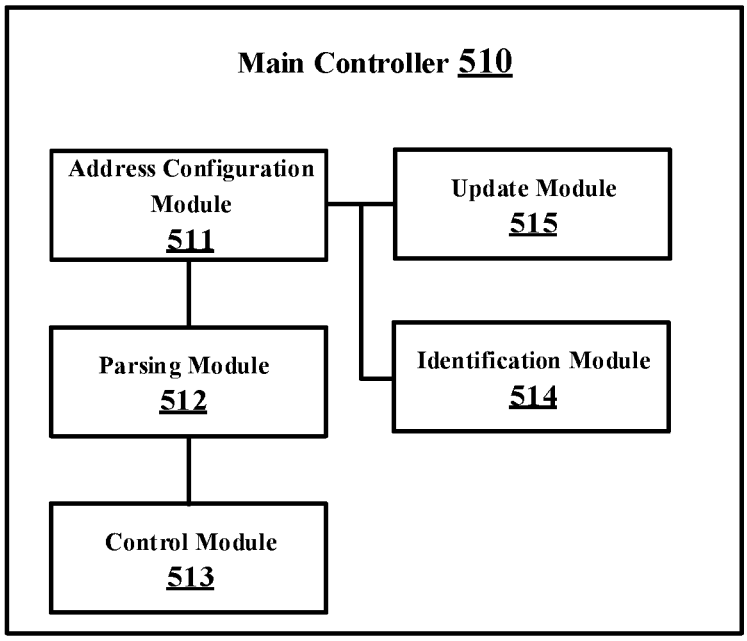
FIG. 6 illustrates a schematic structural diagram of a controller according to an example of the present disclosure.

Referring to FIG. 6, in the example of the present disclosure, the main controller 510 further includes an identification module 514 and an update module 515 in addition to the above-mentioned modules.

The identification module 514 is coupled to the address configuration module 511, and is configured to identify the lamp unit, which is physically connected to the main controller 510, from the combined lamp 520, and take the lamp unit, which is physically connected to the main controller, as a central node. The address configuration module 511 is further configured to: take the lamp unit that is taken as the central node as the reference, and configure the address information for the lamp units 521 of the combined lamp 520 according to the preset algorithm strategy and according to the connection relationship between the lamp units 521 of the combined lamp 520.

The update module 515 is coupled to the address configuration module 511, and is configured to update the address information of the lamp units 521 of the current combined lamp 520 in the case where a new lamp unit is added to the combined lamp 520 or an existing lamp unit is removed from the combined lamp 520.

In an example of the present disclosure, each lamp unit 521 of the combined lamp 520 has at least two IO interfaces, two adjacent lamp units are physically connected to each other through an IO control line, which is connected between two IO interfaces of the two adjacent lamp units, the main controller 510 has at least one IO interface, the main controller 510 is physically connected to any lamp unit through an IO control line, which is connected between an IO interface of the main controller and an IO interface of the any lamp unit.

The address configuration module 511 is further configured to take the lamp unit that is physically connected to any one lamp unit 521 of the lamp units of the combined lamp 520 as a next-stage lamp unit of the any one lamp unit 521, and take the any one lamp unit 521 as a previous-stage lamp unit of the lamp unit that is physically connected to the any one lamp unit 521.

The address configuration module 511 is further configured to assign corresponding address information to the lamp unit that is taken as the central node, and take the lamp unit that is taken as the central node as a previous-stage lamp unit to detect whether an IO interface of the previous-stage lamp unit is connected to a next-stage lamp unit, in a case where the IO interface of the previous-stage lamp unit is connected to the next-stage lamp unit, configure corresponding address information for the next-stage lamp unit that is connected to the previous-stage lamp unit according to the preset algorithm strategy and according address information of the previous-stage lamp unit.

The address configuration module 511 is further configured to continually take the lamp unit with address information that is configured latest as a previous-stage lamp unit, and configure corresponding address information for a next-stage lamp unit, which is connected to an IO interface of the previous-stage lamp unit with the address information that is configured latest, according to the preset algorithm strategy and according to the address information that is configured latest until all the lamp units of the combined lamp 520 are configured to obtain address information.

In an example of the present disclosure, the address configuration module 511 is further configured to establish a coordinate system for the combined lamp 520, configure the coordinate value of the central node according to the coordinate system that is established, and record each lamp unit 521 of the combined lamp 520 as a node, take the central node as a previous-stage node, acquire an IO interface, which is connected to a next-stage node, of the previous-stage node, and determine a coordinate axial direction of the IO interface.

The address configuration module 511 is further configured to determine the node type and the node direction of the next-stage node according to the coordinate axial direction of the IO interface, which is connected to the next-stage node, of the previous-stage node, and determine the coordinate value of the next-stage node by combining with the coordinate value of the previous-stage node, the node type of the next-stage node, and the node direction of the next-stage node.

The address configuration module 511 is further configured to continually take the node with the coordinate value that is determined latest as a previous-stage node, determine the node type and the node direction of the next-stage node, which is connected to the previous-stage node, according to a coordinate axial direction of an IO interface, which is connected to the next-stage node, of the previous-stage node, and determine the coordinate value of the next-stage node in combination with the coordinate value that is determined latest until coordinate values of nodes corresponding to all the lamp units 521 of the combined lamp 520 are determined.

In an example of the present disclosure, the address configuration module 511 is further configured to set corresponding interface numbers for IO interfaces of any node, acquire the interface number of the IO interface, which is connected to the next-stage node, of the previous-stage node, determine the coordinate axial direction of the IO interface corresponding to the interface number, and determine the node type and the node direction of the next-stage node.

In an example of the present disclosure, the address configuration module 511 is further configured to set the interface number of an IO interface, which is connected to the previous-stage node, of the any node as No. 0 IO interface, and the previous-stage node of the central node is the main controller 510.

The address configuration module 511 is further configured to set corresponding interface numbers of IO interfaces other than the No. 0 IO interface sequentially by a manner of increasing numbers in a clockwise direction.

In an example of the present disclosure, the address configuration module 511 is further configured to set the coordinate system that is established to a rectangular coordinate system, and the coordinate axes of the rectangular coordinate system include an x-axis and a y-axis.

The next-stage node, which is connected to an IO interface being in a positive direction of the x-axis, is a positive direction normal node, the node type of the next-stage node is a normal node, and the node direction of the next-stage node is the positive direction of the x-axis.

The next-stage node, which is connected to an IO interface being in a negative direction of the x-axis, is a negative direction normal node, the node type of the next-stage node is a normal node, and the node direction of the next-stage node is the negative direction of the x-axis.

The next-stage node, which is connected to an IO interface being in a positive direction of the y-axis, is a positive direction turning point, the node type of the next-stage node is a turning point, and the node direction of the next-stage node is the positive direction of the y-axis.

The next-stage node, which is connected to an IO interface being in a negative direction of the y-axis, is a negative direction turning point, the node type of the next-stage node is a turning point, and the node direction of the next-stage node is the negative direction of the y-axis.

In an example of the present disclosure, the address configuration module 511 is further configured to set the coordinate value of the previous-stage node as (a, b). The address configuration module 511 is further configured to determine the coordinate value of the next-stage node to be (a+n, b) in the case where the next-stage node that is connected to the previous-stage node is the positive direction normal node, determine the coordinate value of the next-stage node to be (a−n, b) in the case where the next-stage node that is connected to the previous-stage node is the negative direction normal node, determine the coordinate value of the next-stage node to be (a, b+n) in the case where the next-stage node that is connected to the previous-stage node is the positive direction turning point, and determine the coordinate value of the next-stage node to be (a, b−n) in the case where the next-stage node that is connected to the previous-stage node is the negative direction turning point, and n is a positive integer.

In an example of the present disclosure, the lighting system 500 further includes an external device (not illustrated in the figure). The external device may be connected to the parsing module 512 of the main controller 510, and is configured to send the control instruction that controls the light-emitting state of the combined lamp 520 and carries at least one address information to the parsing module 512. The parsing module 512 is configured to receive the control instruction, which controls the light-emitting state of the combined lamp and carries the at least one address information, from the external device, and parse out the at least one address information carried in the control instruction. A wired connection or a wireless connection is established between the external device and the main controller 510.

In an example of the present disclosure, not only the IO interfaces of the lamp units of the combined lamp 520 (as illustrated in FIG. 5) can be connected to each other through the IO control lines to achieve the physical connection among the lamp units, but also the IO interfaces of the lamp units can be connected to each other in the form of conductive terminals. The conductive terminals may be provided on the sidewall of the lamp unit, and the conductive terminals may have two forms. For example, referring to FIG. 7, the lamp unit has a plurality of sidewalls 20, at least one sidewall 20 is provided with first conductive terminals 21, and another sidewall 20 is provided with holes 31 arranged in a row and corresponding to the first conductive terminals 21, and the holes 31 have second conductive terminals (not illustrated in the figure).

Figure 7:
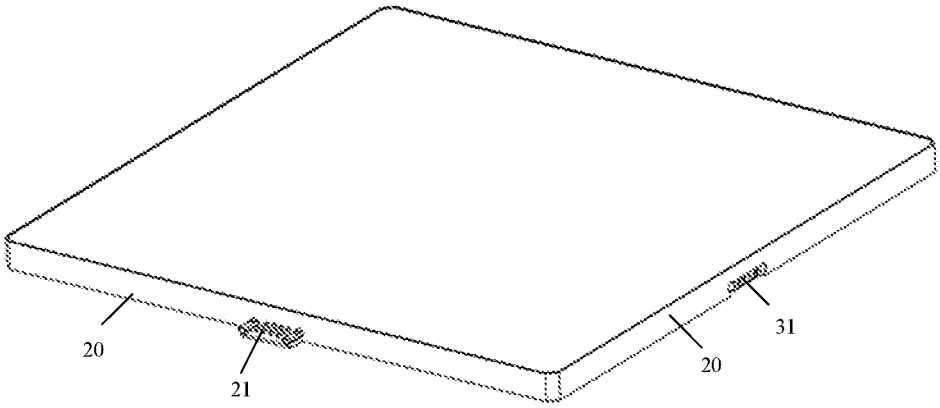
FIG. 7 illustrates a schematic structural diagram of a lamp unit according to an example of the present disclosure.
Figure 8:
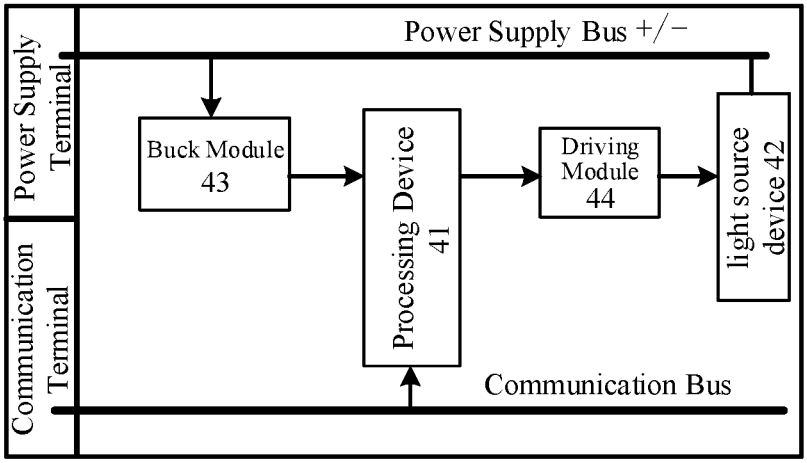
FIG. 8 illustrates a schematic diagram of a structure inside a lamp unit according to an example of the present disclosure.

Referring to FIG. 8, in the present example, the interior of the lamp unit is further provided with a power supply bus, a processing device 41 and a light source device 42 that are connected to the power supply bus, and a communication bus that is connected to the processing device 41, and the processing device 41 receives the control signal through the communication bus to control the light-emitting state of the light source device 42. In addition, the power supply bus is connected to the power supply terminals included in the first conductive terminals 21 (as illustrated in FIG. 7) and the second conductive terminals of the lamp unit, and the communication bus is connected to the communication terminals included in the first conductive terminals 21 and the second conductive terminals of the lamp unit. There are two power supply buses, one of the two power supply buses serves as a positive terminal and the other of the two power supply buses serves as a negative terminal. In FIG. 8, one line is used to represent two power supply buses, which are taken as the positive terminal and the negative terminal, respectively.

Figure 9A:
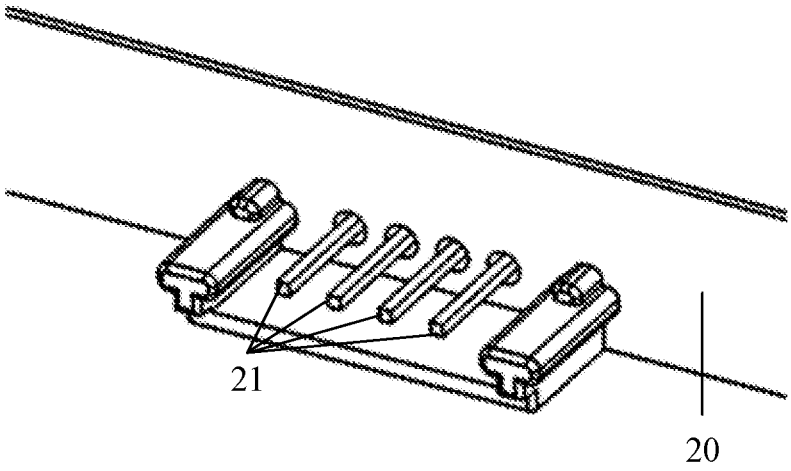
FIG. 9A illustrates a schematic structural diagram of conductive terminals of a lamp unit according to an example of the present disclosure.
Figure 9B:
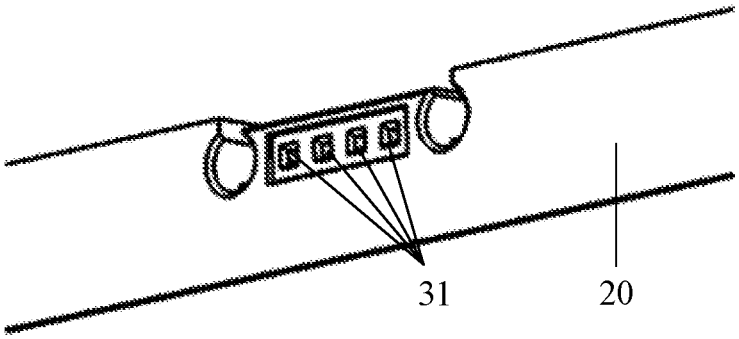
FIG. 9B illustrates a schematic structural diagram of conductive terminals of a lamp unit according to another example of the present disclosure.

In the examples illustrated in FIG. 9A and FIG. 9B, each of the first conductive terminal 21 and the second conductive terminal of the lamp unit has four terminals. And in the four terminals, two terminals are taken as power supply terminals, which are a positive terminal and a negative terminal, and are correspondingly connected the positive terminal and the negative terminal of the power supply bus inside the lamp unit. One communication terminal is connected to the communication bus inside the lamp unit, and is connected to the processing device 41 of the lamp unit through the communication bus (as illustrated in FIG. 8). One identification terminal is connected to an IO interface (not illustrated in the figure) provided inside the sidewall 20 of the lamp unit, and the IO interface on the lamp unit is connected to the processing device 41 of the lamp unit. The identification terminal is used to identify the IO interface, to which the identification terminal is connected, so as to identify which IO interface is connected to the lamp unit, and then, the address information is configured for the lamp unit, which is identified, through the communication bus.

Referring to FIG. 7 to FIG. 9B, in the examples of the present disclosure, two adjacent lamp units are referred to as a first lamp unit and a second lamp unit, respectively. The first conductive terminals 21 of the first lamp unit are inserted into the holes 31 of the second lamp unit and connected to the second conductive terminals in the holes 31, so that the electrical connection and the communication connection between the two adjacent lamp units can be achieved. The communication bus of the first lamp unit receives the control signal from the main controller 510 (as illustrated in FIG. 5), and the control signal is transmitted to the communication bus of the second lamp unit through the conductive terminals plugged into the first lamp unit. If there are other lamp units plugged into the conductive terminals of the second lamp unit, the second lamp unit continues to transmit the control signal via the communication bus through the plugged conductive terminals. The processing device 41 of any lamp unit matches the address information in the control signal with its pre-configured address information.

If the address information consistently matches the pre-configured address information of the any lamp unit, the processing device 41 uses the control signal to control the light-emitting state of the light source device 42 inside the lamp unit, thereby controlling the light-emitting state of the combined lamp. In addition, in order to increase the holding strength of the connection between the first conductive terminal 21 and the second conductive terminal, magnet components (not illustrated in figure) may also be provided on the first conductive terminal 21 and the second conductive terminal, respectively, or the first conductive terminal 21 and the second conductive terminal themselves are set to have magnetism. Thus, after the first conductive terminals 21 of the first lamp unit are inserted into the holes 31 of the second lamp unit having with the second conductive terminals, the first conductive terminal 21 and the second conductive terminal are adsorbed by respective magnet components or both are mutually adsorbed by their own magnetism to achieve the mechanical connection between the adjacent two lamp units.

In the examples of the present disclosure, the main controller may also be physically connected to any lamp unit of the combined lamp through conductive terminals. For example, each of the main controller and the lamp unit has two power supply terminals, one communication terminal, and one identification terminal. After the connection between the main controller and the lamp unit is implemented through the conductive terminals, that is, the connection between the power supply module of the main controller and the power supply bus in each lamp unit is implemented, and the connection between the processing unit (not illustrated in the figure) of the main controller and the communication bus in each lamp unit is implemented. The processing unit of the main controller includes the various modules included in the main controller 510 as illustrated in FIG. 5 and FIG. 6.

Continuing to refer to FIG. 8, in an example of the disclosure, the interior of the lamp unit further includes a buck module 43, one terminal of the buck module 43 is connected to the power supply bus, and the other terminal of the buck module 43 is connected to the processing device 41. The buck module 43 receives the external voltage signal through the power supply bus, stabilizes the external voltage signal to the preset voltage value, and then transmits the external voltage signal that is stabilized to the processing device 41, so as to provide a working voltage for the processing device 41. For example, the preset voltage value is 3.3V, that is, the buck module 43 stabilizes the external voltage signal to 3.3V and provides the external voltage signal that is stabilized to the processing device 41. The preset voltage value may also be other values, which need to be determined according to the working voltage of the processing device 41. In practical applications, the buck module 43 may adopt a voltage converter, which is not limited in the examples of the present disclosure.

In the present example, the interior of the lamp unit further includes a driving module 44, and the driving module 44 is respectively connected to the processing device 41 and the light source device 42 (such as an LED) in the lamp unit. The processing device 41 receives the control signal through the communication bus and processes the control signal, and then transmits the control signal that is processed to the driving module 44. The driving module 44 generates the corresponding driving signal according to the control signal that is processed, and uses the driving signal to drive the light source device 42 to emit light or to be turned off.

In the present example, the control signal may include the signal that controls any lamp unit to emit light or to be turned off, and may also include the signal that performs dimming control and/or color adjustment control on any lamp unit. As mentioned above, the control signal can control one, more, or all lamps of the combined lamp to emit light or to be turned off (that is, do not emit light). Now, it is introduced that the control signal is used to perform dimming control and/or color adjustment control on any lamp unit. For example, after the processing device 41 inside the lamp unit receives the control signal and processes the control signal, the processing device 41 generates a corresponding PWM (pulse width modulation) signal according to the control signal, and then transmits the PWM signal to the driving module 44. The driving module 44 generates a corresponding driving signal according to the PWM signal, and then adjusts the color and/or brightness of the light source device 42. The light source device 42 may adopt an RGB chip, and the PWM signal adjusts the respective percentages of red (R), green (G), and blue (B) in the RGB chip to adjust the color of the light source device 42, that is, the color adjustment of the lamp unit is implemented. The light source device 42 may also adopt a plurality of LEDs of different colors, and the color of the lamp unit can be adjusted by adjusting the LEDs of different colors to be turned on or off. The adjustment of the brightness of the lamp unit is also achieved by the PWM signal, which is generated according to the control signal, corresponding to the duty cycle.

In an example of the present disclosure, if the signal communication between the main controller and the combined lamp is achieved by multiplexing the power line (that is, the power supply bus), that is, no special communication bus is needed to transmit the control signal, while the transmission of the control signal is achieved by the manner of superimposing the control signal on the power supply bus. Correspondingly, in FIG. 9A and FIG. 9B, the first conductive terminal 21 and the second conductive terminal may omit the special communication terminal, while the power supply terminal is used instead of the communication terminal, that is, three terminals (that is, two power supply terminals and one identification terminal) are adopted, and the power supply bus inside the lamp unit is connected to the power supply terminal, and the other parts in the lamp unit remain unchanged. Correspondingly, the conductive terminal of the main controller may also omit the communication terminal, may have three terminals (that is, two power supply terminals and one identification terminal), and may be inserted into and be connected to any lamp unit through the conductive terminals.

In the examples of the present disclosure, the control signal may be a digital signal in the case where the control signal is transmitted through the communication bus, and the control signal may be an analog signal in the case where the control signal is transmitted through the power supply bus. The control signal may also be a signal with other forms, which is not limited in the examples of the present disclosure. In addition, when the main controller transmits the control signal to the combined lamp, the control signal is transmitted based on a customized transmission protocol. For example, after the main controller generates the control signal corresponding the control instruction according to the control instruction, the main controller carries the address information that is obtained by parsing in the control signal, so as to send the control signal that carried the address information to the combined lamp based on the customized transmission protocol. The type of the transmission protocol may be DMX512 (that is, DMX Control 512) protocol, TTL (Time To Live) protocol, Modbus (Modbus protocol) communication protocol, IEC101 protocol, IEC104 (that is, Telecontrol equipment and systems—Part 5-104) protocol, and so on.

In the above descriptions, after the lamp units are inserted into and connected to each other through the conductive terminals and the lamp units are inserted into and connected to the main controller 510 through the conductive terminals, the main controller directly establishes a connection with the identification terminal of the lamp unit through the identification terminal, so that the processing unit of the main controller 510 can identify which IO interface of the lamp unit is connected to a lamp unit through the identification terminal, and then configure the address information for the lamp unit, which is connected to the identified IO interface, through the communication terminal, and the communication between the main controller 510 and the combined lamp 520 is achieved using the communication terminals. The address configuration process and the communication process are described in the above examples, and are not described here again.

According to any one of the above examples or the combination of a plurality of examples, the examples of the present disclosure can achieve the following beneficial effects.

In the examples of the present disclosure, the main controller is connected to any lamp unit of the combined lamp, and the main controller takes a lamp unit that is physically connected to the main controller as a reference, and configures the address information for the lamp units of the combined lamp according to the preset algorithm strategy and according to the connection relationship between the lamp units of the combined lamp. After the main controller receives the control instruction that controls the light-emitting state of the combined lamp and carries at least one address information, the main controller parses out the at least one address information carried in the control instruction, generates the control signal corresponding the control instruction according to the control instruction, and carries the address information that is obtained by parsing in the control signal and sends the control signal to the combined lamp. The lamp unit, which is matched with the address information that is obtained by parsing, of the combined lamp utilizes the control signal to control the light-emitting state of the lamp unit, thereby controlling the light-emitting state of the combined lamp. Therefore, compared with the case where one controller is connected to only one lamp unit in other implementations, the examples of the present disclosure can implement the precise positioning of any lamp unit of the combined lamp, thereby implementing the light emitting control of the any lamp unit according to the positioning of the lamp units, and further implementing the complex coordinating change effect of the lamp units.

The specification provided here explains a lot of details. However, it can be understood that the examples of the present disclosure can be practiced without these details. In some examples, the well-known methods, structures, and techniques are not shown in detail so as not to obscure the understanding of the present description.

Similarly, it should be understood that, in order to streamline the present disclosure and help to understand one or more of the respective inventive aspects, in the above description of the examples of the present disclosure, the respective features of the present disclosure are sometimes grouped together into a single example, diagram, or description thereof. However, the disclosed method should not be interpreted as reflecting an intention below: more features than those explicitly recited in each claim are required in the present disclosure for which protection is claimed. As reflected in the following claims, the inventive aspects are fewer than all the features in single example previously disclosed. Therefore, claims that follow the implementation modes are explicitly incorporated into the implementation modes, and each claim itself is taken as a separate example of the present disclosure.

Those skilled in the art can understand that the modules in the device in the example can be adaptively changed and set in one or more devices different from the example. The modules or units or components in the examples may be combined into one module or unit or component, and in addition, the modules or units or components in the examples also may be divided into a plurality of sub-modules or sub-units or sub-components. Except that at least some of such features and/or process, or units are mutually exclusive, all features disclosed in the present specification (including the accompanying claims, abstract, and drawings) and all processes or units of any method or device disclosed in this specification may be combined by any combination. Unless expressly stated otherwise, each feature disclosed in the present specification (including the accompanying claims, abstract, and drawings) may be replaced by an alternative feature providing the same, equivalent, or similar purpose.

In addition, those skilled in the art can understand that although some of the examples described herein include certain features included in other examples instead of other features, the combination of features of different examples means that the combination of features of different examples are within the scope of the present disclosure, and different examples are formed.

The examples of the various components of the present disclosure may be implemented in hardware, or implemented in software modules running on one or more processors, or implemented in a combination thereof. Those skilled in the art should understand that, in practice, a microprocessor or a digital signal processor (DSP) may be used to implement some or all functions of some or all components in the lighting system according to the examples of the present disclosure. The present disclosure may also be implemented as a device or device program (for example, computer program and computer program product) for performing part or all of the method described herein. Such the program implementing the present disclosure may be stored on a computer readable medium, or may have the form of one or more signals. Such the signal can be downloaded from an interne website, or can be provided on a carrier signal, or can be provided in any other form.

Figure 10:
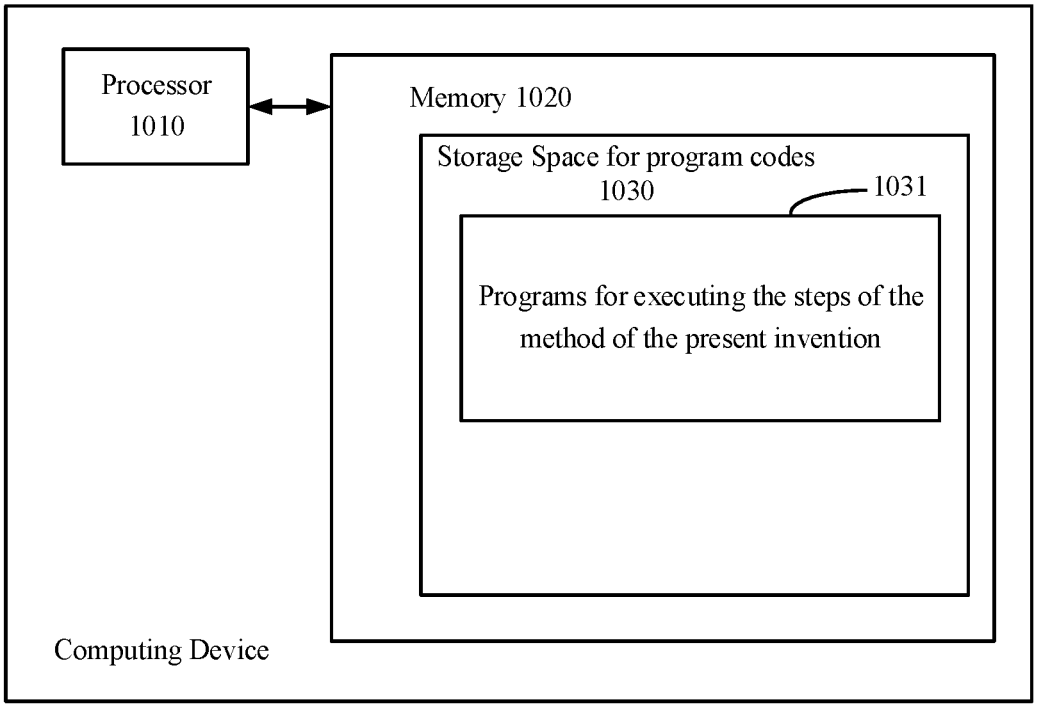
FIG. 10 illustrates a block diagram of a computing device for performing the method for controlling the combined lamp according to the present disclosure.

Referring to FIG. 10, an example of the present disclosure further provides an electronic device that can implement the method for controlling the combined lamp, that is, the computing device illustrated in FIG. 10 includes a processor 1010 and a memory 1020 that is configured to store computer executable instructions, and in the case where the computer executable instructions are executed, the computer executable instructions enable the processor 1010 to execute the method for controlling the combined lamp according to the above examples.

In addition, an example of the present disclosure further provides a computer storage medium, the storage medium stores one or more programs, and in the case where the one or more programs are executed by an electronic device including a plurality of application programs, the one or more programs enable the electronic device to execute the method for controlling the combined lamp according to the above examples.

Figure 11:
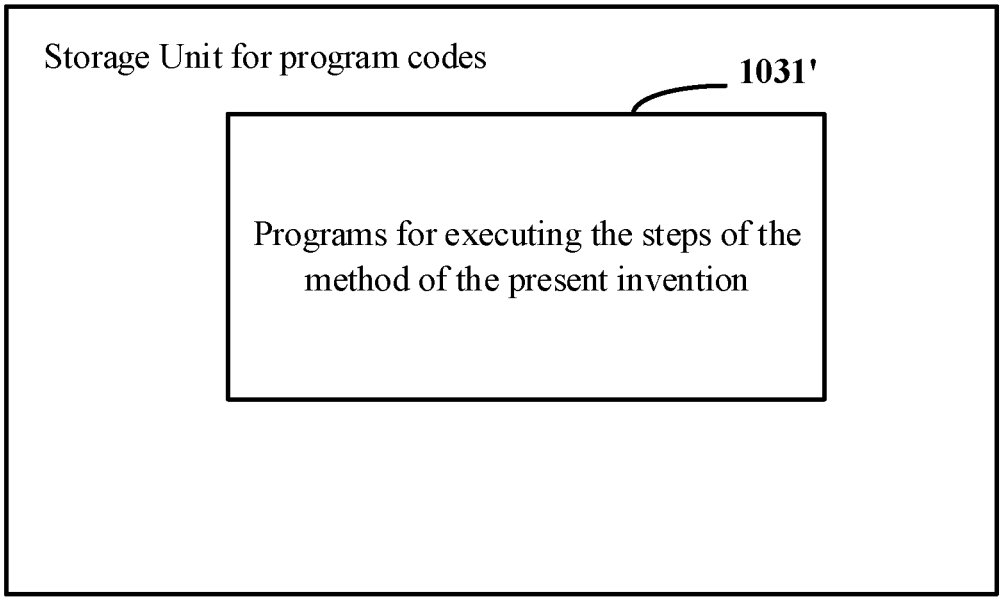
FIG. 11 illustrates a storage unit for holding or carrying program codes for implementing the method for controlling the combined lamp according to the present disclosure.

The memory 1020 may be an electronic memory such as flash memory, EEPROM (electrically erasable programmable read only memory), EPROM, hard disk, or ROM. The memory 1020 has a storage space 1030 that stores the program 1031 for executing any of the steps of the method described above. For example, the storage space 1030 storing program codes may include various programs 1031 for implementing the various steps of the method described above, respectively. These program codes may be read from or written into one or more computer program products. These computer program products include program code carrier such as hard disks, compact disks (CDs), memory cards, or floppy disks. Such the computer program product is usually a portable or fixed storage unit as illustrated in FIG. 11, for example. The storage unit may have storage sections, storage spaces, and the like arranged similarly to the memory 1020 in the computing device illustrated in FIG. 10. The program codes may be compressed in an appropriate form, for example. Generally, the storage unit includes the program 1031' for executing the steps of the method of the present disclosure, that is, codes that can be read by a processor such as 1010, and in the case these codes are executed by a computing device, the computing device is caused to perform the various steps of the method described above.

The present disclosure provides a method for controlling a combined lamp, a lighting system and an electronic device.

According to an aspect of the present disclosure, a method for controlling a combined lamp is provided, the method is applied to a main controller for controlling the combined lamp to emit light, the combined lamp comprises at least two lamp units that are connected to each other in sequence, the main controller is physically connected to any lamp unit of the combined lamp, and the method comprises:

taking a lamp unit, which is physically connected to the main controller, as a reference, configuring address information for lamp units of the combined lamp according to a preset algorithm strategy and according to a connection relationship between the lamp units of the combined lamp;

receiving a control instruction that controls a light-emitting state of the combined lamp and carries at least one address information, and parsing out the at least one address information carried in the control instruction; and generating a control signal corresponding the control instruction according to the control instruction, carrying the at least one address information that is obtained by parsing in the control signal and sending the control signal to the combined lamp, and enabling a lamp unit, which is matched with the at least one address information in the control signal, to utilize the control signal to control a light-emitting state of the lamp unit, which is matched with the at least one address information in the control signal, thereby controlling the light-emitting state of the combined lamp.

Optionally, taking the lamp unit, which is physically connected to the main controller, as the reference, configuring the address information for the lamp units of the combined lamp according to the preset algorithm strategy and according to the connection relationship between the lamp units of the combined lamp, further comprises:

identifying the lamp unit, which is physically connected to the main controller, from the combined lamp, and taking the lamp unit, which is physically connected to the main controller, as a central node; and taking the lamp unit that is taken as the central node as the reference, configuring the address information for the lamp units of the combined lamp according to the preset algorithm strategy and according to the connection relationship between the lamp units of the combined lamp.

Optionally, each lamp unit of the combined lamp has at least two IO interfaces, two adjacent lamp units of the combined lamp are physically connected to each other through an IO control line, which is connected between two IO interfaces of the two adjacent lamp units, the main controller has at least one IO interface, the main controller is physically connected to any lamp unit through an IO control line that is connected between an IO interface of the main controller and an IO interface of the any lamp unit, and taking the lamp unit that is taken as the central node as the reference, configuring the address information for the lamp units of the combined lamp according to the preset algorithm strategy and according to the connection relationship between the lamp units of the combined lamp, comprises:

taking a lamp unit that is physically connected to any one lamp unit of the lamp units of the combined lamp as a next-stage lamp unit of the any one lamp unit, and taking the any one lamp unit as a previous-stage lamp unit of the lamp unit that is physically connected to the any one lamp unit;

assigning corresponding address information to the lamp unit that is taken as the central node;

taking the lamp unit that is taken as the central node as a previous-stage lamp unit to detect whether an IO interface of the previous-stage lamp unit is connected to a next-stage lamp unit;

in a case where the IO interface of the previous-stage lamp unit is connected to the next-stage lamp unit, configuring corresponding address information for the next-stage lamp unit that is connected to the previous-stage lamp unit according to the preset algorithm strategy and according address information of the previous-stage lamp unit; and continually taking a lamp unit with address information that is configured latest as a previous-stage lamp unit, and configuring corresponding address information for a next-stage lamp unit, which is connected to an IO interface of the previous-stage lamp unit with the address information that is configured latest, according to the preset algorithm strategy and according to the address information that is configured latest until all the lamp units of the combined lamp are configured to obtain address information.

Optionally, configuring the address information for the lamp units of the combined lamp according to the preset algorithm strategy comprises:

establishing a coordinate system for the combined lamp, and configuring a coordinate value of the central node according to the coordinate system that is established;

recording each lamp unit of the combined lamp as a node, taking the central node as a previous-stage node, acquiring an IO interface, which is connected to a next-stage node, of the previous-stage node, and determining a coordinate axial direction of the IO interface;

determining a node type and a node direction of the next-stage node according to the coordinate axial direction of the IO interface, which is connected to the next-stage node, of the previous-stage node, and determining a coordinate value of the next-stage node by combining with a coordinate value of the previous-stage node, the node type of the next-stage node, and the node direction of the next-stage node; and continually taking a node with a coordinate value that is determined latest as a previous-stage node, determining a node type and a node direction of a next-stage node, which is connected to the previous-stage node, according to a coordinate axial direction of an IO interface, which is connected to the next-stage node, of the previous-stage node, and determining a coordinate value of the next-stage node in combination with the coordinate value that is determined latest until coordinate values of nodes corresponding to all the lamp units of the combined lamp are determined.

Optionally, determining the node type and the node direction of the next-stage node according to the coordinate axial direction of the IO interface, which is connected to the next-stage node, of the previous-stage node comprises:

setting corresponding interface numbers for IO interfaces of any node; and acquiring an interface number of the IO interface, which is connected to the next-stage node, of the previous-stage node, determining the coordinate axial direction of the IO interface corresponding to the interface number, and determining the node type and the node direction of the next-stage node.

Optionally, setting corresponding interface numbers for IO interfaces of any node comprises:

setting an interface number of an IO interface, which is connected to the previous-stage node, of the any node as No. 0 IO interface, a previous-stage node of the central node being the main controller; and setting corresponding interface numbers of IO interfaces other than the No. 0 IO interface sequentially by a manner of increasing numbers in a clockwise direction.

Optionally, determining the node type and the node direction of the next-stage node according to the coordinate axial direction of the IO interface, which is connected to the next-stage node, of the previous-stage node comprises:

setting the coordinate system that is established to a rectangular coordinate system, coordinate axes of the rectangular coordinate system comprising an x-axis and a y-axis, a next-stage node, which is connected to an IO interface being in a positive direction of the x-axis, is a positive direction normal node, a node type of the next-stage node is a normal node, and a node direction of the next-stage node is the positive direction of the x-axis;

a next-stage node, which is connected to an IO interface being in a negative direction of the x-axis, is a negative direction normal node, a node type of the next-stage node is a normal node, and a node direction of the next-stage node is the negative direction of the x-axis;

a next-stage node, which is connected to an IO interface being in a positive direction of the y-axis, is a positive direction turning point, a node type of the next-stage node is a turning point, and the node direction of the next-stage node is the positive direction of the y-axis; and a next-stage node, which is connected to an IO interface being in a negative direction of the y-axis, is a negative direction turning point, a node type of the next-stage node is a turning point, and a node direction of the next-stage node is the negative direction of the y-axis.

Optionally, determining the coordinate value of the next-stage node by combining with a coordinate value of the previous-stage node, the node type of the next-stage node, and the node direction of the next-stage node, comprises:

setting the coordinate value of the previous-stage node as (a, b);

determining the coordinate value of the next-stage node to be (a+n, b) in a case where the next-stage node that is connected to the previous-stage node is the positive direction normal node;

determining the coordinate value of the next-stage node to be (a−n, b) in a case where the next-stage node that is connected to the previous-stage node is the negative direction normal node;

determining the coordinate value of the next-stage node to be (a, b+n) in a case where the next-stage node that is connected to the previous-stage node is the positive direction turning point; and determining the coordinate value of the next-stage node to be (a, b−n) in a case where the next-stage node that is connected to the previous-stage node is the negative direction turning point, n being a positive integer.

Optionally, receiving the control instruction that controls the light-emitting state of the combined lamp and carries at least one address information, and parsing out the at least one address information carried in the control instruction, comprises:

receiving the control instruction, which controls the light-emitting state of the combined lamp and carries the at least one address information, from an external device, and parsing out the at least one address information carried in the control instruction. A wired connection or a wireless connection is established between the external device and the main controller.

Optionally, the main controller sequentially communicates with the lamp units through a communication bus, generating the control signal corresponding the control instruction according to the control instruction, carrying the at least one address information that is obtained by parsing in the control signal and sending the control signal to the combined lamp, and enabling the lamp unit, which is matched with the at least one address information in the control signal, to utilize the control signal to control the light-emitting state of the lamp unit, which is matched with the at least one address information in the control signal, thereby controlling the light-emitting state of the combined lamp, comprises:

generating the control signal corresponding the control instruction according to the control instruction, carrying the at least one address information that is obtained by parsing in the control signal and sending the control signal to the lamp units of the combined lamp through the communication bus, enabling the lamp unit to match the at least one address information in the control signal with the address information of the lamp unit, and to utilize the control signal to control the light-emitting state of the lamp unit in a case where the at least one address information in the control signal is successfully matched with the address information of the lamp unit, thereby controlling the light-emitting state of the combined lamp.

The main controller is provided with a main communication module, each lamp unit is provided with a slave communication module corresponding to the main communication module, and the main communication module is sequentially connected to respective slave communication modules through a single bus. Generating the control signal corresponding the control instruction according to the control instruction, sending the control signal to a corresponding target lamp unit, utilizing the control signal to control a light-emitting state of the target lamp unit, thereby controlling the light-emitting state of the combined lamp, comprises:

generating the control signal corresponding the control instruction according to the control instruction, utilizing the main communication module to send the control signal to a slave communication module of a corresponding target lamp unit through the single bus, and utilizing the control signal to control a light-emitting state of the corresponding target lamp unit, thereby controlling the light-emitting state of the combined lamp.

Optionally, in a case where a new lamp unit is added to the combined lamp or an existing lamp unit is removed from the combined lamp to determine a current combined lamp, address information of lamp units of the current combined lamp is updated.

Optionally, the control signal comprises a signal that controls any lamp unit to emit light or to be turned off, and/or a signal that performs dimming control and/or color adjustment control on any lamp unit, and a type of the control signal comprises a digital signal type.

Optionally, generating the control signal corresponding the control instruction according to the control instruction, carrying the at least one address information that is obtained by parsing in the control signal and sending the control signal to the combined lamp, comprises:

generating the control signal corresponding the control instruction according to the control instruction, carrying the at least one address information that is obtained by parsing in the control signal, and sending the control signal to the combined lamp based on a customized transmission protocol.

According to another aspect of the present disclosure, a lighting system is further provided, and the lighting system comprises a main controller and a combined lamp.

The combined lamp comprises at least two lamp units that are connected to each other in sequence.

The main controller is physically connected to any lamp unit of the combined lamp, and comprises an address configuration module, a parsing module, and a control module.

The address configuration module is configured to: take a lamp unit that is physically connected to the main controller as a reference, and configure address information for lamp units of the combined lamp according to a preset algorithm strategy and according to a connection relationship between the lamp units of the combined lamp;

the parsing module is configured to receive a control instruction that controls a light-emitting state of the combined lamp and carries at least one address information, and parse out the at least one address information carried in the control instruction; and the control module is configured to generate a control signal corresponding the control instruction according to the control instruction, carry the at least one address information that is obtained by parsing in the control signal and sent the control signal to the combined lamp, and enable a lamp unit, which is matched with the at least one address information in the control signal, to utilize the control signal to control a light-emitting state of the lamp unit, which is matched with the at least one address information in the control signal, thereby controlling the light-emitting state of the combined lamp.

Optionally, the main controller further comprises an identification module, the identification module is configured to identify the lamp unit, which is physically connected to the main controller, from the combined lamp, and take the lamp unit, which is physically connected to the main controller, as a central node; and the address configuration module is further configured to: take the lamp unit that is taken as the central node as the reference, and configure the address information for the lamp units of the combined lamp according to the preset algorithm strategy and according to the connection relationship between the lamp units of the combined lamp.

Optionally, each lamp unit of the combined lamp has at least two IO interfaces, two adjacent lamp units of the combined lamp are physically connected to each other through an IO control line that is connected between two IO interfaces of the two adjacent lamp units, the main controller has at least one IO interface, the main controller is physically connected to any lamp unit through an IO control line that is connected between an IO interface of the main controller and an IO interface of the any lamp unit; and the address configuration module is further configured to take a lamp unit that is physically connected to any one lamp unit of the lamp units of the combined lamp as a next-stage lamp unit of the any one lamp unit, and take the any one lamp unit as a previous-stage lamp unit of the lamp unit that is physically connected to the any one lamp unit;

assign corresponding address information to the lamp unit that is taken as the central node, and take the lamp unit that is taken as the central node as a previous-stage lamp unit to detect whether an IO interface of the previous-stage lamp unit is connected to a next-stage lamp unit, in a case where the IO interface of the previous-stage lamp unit is connected to the next-stage lamp unit, configure corresponding address information for the next-stage lamp unit that is connected to the previous-stage lamp unit according to the preset algorithm strategy and according an address information of the previous-stage lamp unit; and continually take a lamp unit with address information that is configured latest as a previous-stage lamp unit, and configure corresponding address information for a next-stage lamp unit, which is connected to an IO interface of the previous-stage lamp unit with the address information that is configured latest, according to the preset algorithm strategy and according to the address information that is configured latest until all the lamp units of the combined lamp are configured to obtain address information.

Optionally, the address configuration module is further configured to establish a coordinate system for the combined lamp, configure a coordinate value of the central node according to the coordinate system that is established, and record each lamp unit of the combined lamp as a node, take the central node as a previous-stage node, acquire an IO interface, which is connected to a next-stage node, of the previous-stage node, and determine a coordinate axial direction of the IO interface;

determine a node type and a node direction of the next-stage node according to the coordinate axial direction of the IO interface, which is connected to the next-stage node, of the previous-stage node, and determine a coordinate value of the next-stage node by combining with a coordinate value of the previous-stage node, the node type of the next-stage node, and the node direction of the next-stage node; and continually take a node with a coordinate value that is determined latest as a previous-stage node, determine a node type and a node direction of a next-stage node, which is connected to the previous-stage node, according to a coordinate axial direction of an IO interface, which is connected to the next-stage node, of the previous-stage node, and determine a coordinate value of the next-stage node in combination with the coordinate value that is determined latest until coordinate values of nodes corresponding to all the lamp units of the combined lamp are determined.

Optionally, the address configuration module is further configured to set corresponding interface numbers for IO interfaces of any node, acquire an interface number of the IO interface, which is connected to the next-stage node, of the previous-stage node, determine the coordinate axial direction of the IO interface corresponding to the interface number, and determine the node type and the node direction of the next-stage node.

Optionally, the address configuration module is further configured to set an interface number of an IO interface, which is connected to the previous-stage node, of the any node as No. 0 IO interface, the previous-stage node of the central node being the main controller, and set corresponding interface numbers of IO interfaces other than the No. 0 IO interface sequentially by a manner of increasing numbers in a clockwise direction.

Optionally, the address configuration module is further configured to set the coordinate system that is established to a rectangular coordinate system, coordinate axes of the rectangular coordinate system comprise an x-axis and a y-axis, a next-stage node, which is connected to an IO interface being in a positive direction of the x-axis, is a positive direction normal node, a node type of the next-stage node is a normal node, and a node direction of the next-stage node is the positive direction of the x-axis;

a next-stage node, which is connected to an IO interface being in a negative direction of the x-axis, is a negative direction normal node, a node type of the next-stage node is a normal node, and a node direction of the next-stage node is the negative direction of the x-axis;

a next-stage node, which is connected to an IO interface being in a positive direction of the y-axis, is a positive direction turning point, a node type of the next-stage node is a turning point, and a node direction of the next-stage node is the positive direction of the y-axis; and a next-stage node, which is connected to an IO interface being in a negative direction of the y-axis, is a negative direction turning point, a node type of the next-stage node is a turning point, and a node direction of the next-stage node is the negative direction of the y-axis.

Optionally, the address configuration module is further configured to set the coordinate value of the previous-stage node as (a, b);

determine the coordinate value of the next-stage node to be (a+n, b) in a case where the next-stage node that is connected to the previous-stage node is the positive direction normal node;

determine the coordinate value of the next-stage node to be (a−n, b) in a case where the next-stage node that is connected to the previous-stage node is the negative direction normal node;

determine the coordinate value of the next-stage node to be (a, b+n) in a case where the next-stage node that is connected to the previous-stage node is the positive direction turning point; and determine the coordinate value of the next-stage node to be (a, b−n) in a case where the next-stage node that is connected to the previous-stage node is the negative direction turning point, n is a positive integer.

Optionally, the system further comprises an external device, the external device is connected to the parsing module of the main controller, and is configured to send the control instruction that controls the light-emitting state of the combined lamp and carries the at least one address information to the parsing module; and the parsing module is configured to receive the control instruction, which controls the light-emitting state of the combined lamp and carries the at least one address information, from an external device, and parse out the at least one address information carried in the control instruction, a wired connection or a wireless connection is established between the external device and the main controller.

Optionally, the main controller sequentially communicates with the lamp units through a communication bus, the main controller generates the control signal corresponding the control instruction according to the control instruction, and carries the at least one address information that is obtained by parsing in the control signal and sends the control signal to the lamp units of the combined lamp through the communication bus; and the lamp unit matches the at least one address information in the control signal with address information of the lamp unit, and utilizes the control signal to control the light-emitting state of the lamp unit in a case where the at least one address information in the control signal is successfully matched with the address information of the lamp unit, thereby controlling the light-emitting state of the combined lamp.

Optionally, the main controller further comprises an update module, in a case where a new lamp unit is added to the combined lamp or an existing lamp unit is removed from the combined lamp to determine a current combined lamp, the update module is configured to update the address information of the lamp units of the current combined lamp.

Optionally, the control signal comprises a signal that controls any lamp unit to emit light or to be turned off, and/or a signal that performs dimming control and/or color adjustment control on any lamp unit, and a type of the control signal comprises a digital signal type.

Optionally, the control module is further configured to generate the control signal corresponding the control instruction according to the control instruction, carry the at least one address information that is obtained by parsing in the control signal, and send the control signal to the combined lamp based on a customized transmission protocol.

According to another aspect of the present disclosure, an electronic device is further provided, and the electronic device comprises a processor; and a memory configured to store computer executable instructions, in a case where the computer executable instructions are executed, the executable instructions enable the processor to execute the method for controlling the combined lamp according to any one of the above examples.

According to another aspect of the present disclosure, a computer storage medium is further provided, the computer storage medium stores one or more programs, and in a case where the one or more programs are executed by an electronic device comprising a plurality of application programs, the one or more programs enable the electronic device to execute the method for controlling the combined lamp according to any one of the above examples.

In the examples of the present disclosure, the main controller is connected to any lamp unit of the combined lamp, and the main controller takes a lamp unit that is physically connected to the main controller as a reference, and configures address information for the lamp units of the combined lamp according to a preset algorithm strategy and according to a connection relationship between the lamp units of the combined lamp. After the main controller receives a control instruction that controls a light-emitting state of the combined lamp and carries at least one address information, the main controller parses out the at least one address information carried in the control instruction, generates a control signal corresponding the control instruction according to the control instruction, and carries the at least one address information that is obtained by parsing in the control signal and sends the control signal to the combined lamp; a lamp unit, which is matched with the at least one address information that is obtained by parsing, of the combined lamp utilizes the control signal to control a light-emitting state of the lamp unit, thereby controlling the light-emitting state of the combined lamp. Therefore, compared with the case where one controller is connected to only one lamp unit in other implementations, the examples of the present disclosure can implement the precise positioning of any lamp unit in the combined lamp, thereby implementing the light emitting control of the any lamp unit according to the positioning of the lamp units, and further implementing the complex coordinating change effect of a plurality of lamp units.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

So far, it should be recognized by those skilled in the art that, although a plurality of examples of the present disclosure are illustrated and described in detail herein, many other variations or modifications that conform to the principles of the present disclosure may still be directly determined or derived from the contents disclosed by the present disclosure without departing from the spirit and scope of the present disclosure. Therefore, the scope of the present disclosure should be understood and confirmed as covering all the other variations or modifications.

What is claimed is:

1. A method for controlling a combined lamp, wherein the method is applied to a main controller for controlling the combined lamp to emit light, the combined lamp comprises at least two lamp units that are connected to each other in sequence, the main controller is physically connected to any lamp unit of the combined lamp, and the method comprises:

taking a lamp unit of the at least two lamp units that is physically connected to the main controller as a reference, configuring address information for lamp units of the combined lamp according to a preset algorithm strategy and according to a connection relationship between the lamp units of the combined lamp;

receiving a control instruction that controls a light-emitting state of the combined lamp and carries at least one address information, and parsing out the at least one address information carried in the control instruction; and generating a control signal corresponding the control instruction according to the control instruction, carrying the at least one address information that is obtained by parsing in the control signal and sending the control signal to the combined lamp, and enabling a lamp unit, which is matched with the at least one address information in the control signal, to utilize the control signal to control a light-emitting state of the lamp unit, which is matched with the at least one address information in the control signal, wherein each lamp unit of the combined lamp has at least two IO interfaces, wherein two adjacent lamp units of the combined lamp are physically connected to each other through an IO control line that is connected between two IO interfaces of the two adjacent lamp units, the main controller has at least one IO interface, wherein the main controller is physically connected to any lamp unit through an IO control line that is connected between an IO interface of the main controller and an IO interface of the any lamp; and wherein the address information for the lamp units of the combined lamp are configured by identifying a lamp unit physically connected to the main controller as a central node and a next-stage lamp unit of the central node.

2. The method according to claim 1, wherein taking the lamp unit that is physically connected to the main controller as the reference, configuring the address information for the lamp units of the combined lamp according to the preset algorithm strategy and according to the connection relationship between the lamp units of the combined lamp, further comprises:

identifying the lamp unit, which is physically connected to the main controller, from the combined lamp, and taking the lamp unit, which is physically connected to the main controller, as the central node; and taking the lamp unit that is taken as the central node as the reference, configuring the address information for the lamp units of the combined lamp according to the preset algorithm strategy and according to the connection relationship between the lamp units of the combined lamp.

3. The method according to claim 2, wherein:

taking the lamp unit that is taken as the central node as the reference, configuring the address information for the lamp units of the combined lamp according to the preset algorithm strategy and according to the connection relationship between the lamp units of the combined lamp, comprises:

taking a lamp unit that is physically connected to any one lamp unit of the lamp units of the combined lamp as a next-stage lamp unit of the any one lamp unit, and taking the any one lamp unit as a previous-stage lamp unit of the lamp unit that is physically connected to the any one lamp unit;

assigning corresponding address information to the lamp unit that is taken as the central node;

taking the lamp unit that is taken as the central node as a previous-stage lamp unit to detect whether an IO interface of the previous-stage lamp unit is connected to a next-stage lamp unit;

in a case where the IO interface of the previous-stage lamp unit is connected to the next-stage lamp unit, configuring corresponding address information for the next-stage lamp unit that is connected to the previous-stage lamp unit according to the preset algorithm strategy and according address information of the previous-stage lamp unit; and continually taking a lamp unit with address information that is configured latest as a previous-stage lamp unit, and configuring corresponding address information for a next-stage lamp unit, which is connected to an IO interface of the previous-stage lamp unit with the address information that is configured latest, according to the preset algorithm strategy and according to the address information that is configured latest until all the lamp units of the combined lamp are configured to obtain address information.

4. The method according to claim 3, wherein configuring the address information for the lamp units of the combined lamp according to the preset algorithm strategy further comprises:

establishing a coordinate system for the combined lamp, and configuring a coordinate value of the central node according to the coordinate system that is established;

recording each lamp unit of the combined lamp as a node, taking the central node as a previous-stage node, acquiring an IO interface, which is connected to a next-stage node, of the previous-stage node, and determining a coordinate axial direction of the IO interface;

determining a node type and a node direction of the next-stage node according to the coordinate axial direction of the IO interface, which is connected to the next-stage node, of the previous-stage node, and determining a coordinate value of the next-stage node by combining with a coordinate value of the previous-stage node, the node type of the next-stage node, and the node direction of the next-stage node; and continually taking a node with a coordinate value that is determined latest as a previous-stage node, determining a node type and a node direction of a next-stage node, which is connected to the previous-stage node, according to a coordinate axial direction of an IO interface, which is connected to the next-stage node, of the previous-stage node, and determining a coordinate value of the next-stage node in combination with the coordinate value that is determined latest until coordinate values of nodes corresponding to all the lamp units of the combined lamp are determined.

5. The method according to claim 3, wherein:

the main controller sequentially communicates with the lamp units through a communication bus, and generating the control signal corresponding the control instruction according to the control instruction, carrying the at least one address information that is obtained by parsing in the control signal and sending the control signal to the combined lamp, and enabling the lamp unit, which is matched with the at least one address information in the control signal, to utilize the control signal to control the light-emitting state of the lamp unit, which is matched with the at least one address information in the control signal, thereby controlling the light-emitting state of the combined lamp, further comprises:

generating the control signal corresponding the control instruction according to the control instruction, carrying the at least one address information that is obtained by parsing in the control signal and sending the control signal to the lamp units of the combined lamp through the communication bus, enabling the lamp unit to match the at least one address information in the control signal with address information of the lamp unit, and to utilize the control signal to control the light-emitting state of the lamp unit in a case where the at least one address information in the control signal is successfully matched with the address information of the lamp unit, thereby controlling the light-emitting state of the combined lamp.

6. The method according to claim 4, wherein determining the node type and the node direction of the next-stage node according to the coordinate axial direction of the IO interface, which is connected to the next-stage node, of the previous-stage node, further comprises:

setting corresponding interface numbers for IO interfaces of any node; and acquiring an interface number of the IO interface, which is connected to the next-stage node, of the previous-stage node, determining the coordinate axial direction of the IO interface corresponding to the interface number, and determining the node type and the node direction of the next-stage node.

7. The method according to claim 6, wherein setting corresponding interface numbers for IO interfaces of any node further comprises:

setting an interface number of an IO interface, which is connected to the previous-stage node, of the any node as No. 0 IO interface, wherein a previous-stage node of the central node is the main controller; and setting corresponding interface numbers of IO interfaces other than the No. 0 IO interface sequentially by a manner of increasing numbers in a clockwise direction.

8. The method according to claim 4, wherein determining the node type and the node direction of the next-stage node according to the coordinate axial direction of the IO interface, which is connected to the next-stage node, of the previous-stage node, further comprises:

setting the coordinate system that is established to a rectangular coordinate system, coordinate axes of the rectangular coordinate system comprising an x-axis and a y-axis, wherein:

a next-stage node, which is connected to an IO interface being in a positive direction of the x-axis, is a positive direction normal node, a node type of the next-stage node is a normal node, and a node direction of the next-stage node is the positive direction of the x-axis;

a next-stage node, which is connected to an IO interface being in a negative direction of the x-axis, is a negative direction normal node, a node type of the next-stage node is a normal node, and a node direction of the next-stage node is the negative direction of the x-axis;

a next-stage node, which is connected to an IO interface being in a positive direction of the y-axis, is a positive direction turning point, a node type of the next-stage node is a turning point, and a node direction of the next-stage node is the positive direction of the y-axis; and a next-stage node, which is connected to an IO interface being in a negative direction of the y-axis, is a negative direction turning point, a node type of the next-stage node is a turning point, and a node direction of the next-stage node is the negative direction of the y-axis.

9. The method according to claim 8, wherein determining the coordinate value of the next-stage node by combining with a coordinate value of the previous-stage node, the node type of the next-stage node, and the node direction of the next-stage node, further comprises:

setting the coordinate value of the previous-stage node as (a, b);

determining the coordinate value of the next-stage node to be (a+n, b) in a case where the next-stage node that is connected to the previous-stage node is the positive direction normal node;

determining the coordinate value of the next-stage node to be (a−n, b) in a case where the next-stage node that is connected to the previous-stage node is the negative direction normal node;

determining the coordinate value of the next-stage node to be (a, b+n) in a case where the next-stage node that is connected to the previous-stage node is the positive direction turning point; and determining the coordinate value of the next-stage node to be (a, b−n) in a case where the next-stage node that is connected to the previous-stage node is the negative direction turning point, and wherein n is a positive integer.

10. The method according to claim 1, wherein receiving the control instruction that controls the light-emitting state of the combined lamp and carries the at least one address information, and parsing out the at least one address information carried in the control instruction, further comprises:

receiving the control instruction, which controls the light-emitting state of the combined lamp and carries the at least one address information, from an external device, and parsing out the at least one address information carried in the control instruction, wherein a wired connection or a wireless connection is established between the external device and the main controller.

11. The method according to claim 1, wherein in a case where a new lamp unit is added to the combined lamp or an existing lamp unit is removed from the combined lamp to determine a current combined lamp, address information of lamp units of the current combined lamp is updated.

12. The method according to claim 1, wherein the control signal comprises a signal that controls any lamp unit to emit light or to be turned off, and/or a signal that performs dimming control and/or color adjustment control on any lamp unit, and wherein a type of the control signal comprises a digital signal type.

13. The method according to claim 1, wherein generating the control signal corresponding the control instruction according to the control instruction, carrying the at least one address information that is obtained by parsing in the control signal and sending the control signal to the combined lamp, comprises:

generating the control signal corresponding the control instruction according to the control instruction, carrying the at least one address information that is obtained by parsing in the control signal, and sending the control signal to the combined lamp based on a customized transmission protocol.

14. A lighting system, comprising a main controller and a combined lamp, wherein:

the combined lamp comprises at least two lamp units that are connected to each other; the main controller is physically connected to any lamp unit of the combined lamp, and the main controller comprises an address configuration circuit, a parsing circuit, and a control circuit, wherein:

the address configuration circuit is configured to: take a lamp unit of the at least two lamp units that is physically connected to the main controller as a reference, and configure address information for lamp units of the combined lamp according to a preset algorithm strategy and according to a connection relationship between the lamp units of the combined lamp;

the parsing circuit is configured to receive a control instruction that controls a light-emitting state of the combined lamp and carries at least one address information, and parse out the at least one address information carried in the control instruction; and the control circuit is configured to generate a control signal corresponding the control instruction according to the control instruction, carry the at least one address information that is obtained by parsing in the control signal and sent the control signal to the combined lamp, and enable a lamp unit, which is matched with the at least one address information in the control signal, to utilize the control signal to control a light-emitting state of the lamp unit, which is matched with the at least one address information in the control signal, wherein each lamp unit of the combined lamp has at least two IO interfaces, wherein two adjacent lamp units of the combined lamp are physically connected to each other through an IO control line that is connected between two IO interfaces of the two adjacent lamp units, the main controller has at least one IO interface, the main controller is physically connected to any lamp unit through an IO control line that is connected between an IO interface of the main controller and an IO interface of the any lamp unit, and wherein the address information for the lamp units of the combined lamp are configured by identifying a lamp unit physically connected to the main controller as a central node and a next-stage lamp unit of the central node.

15. The system according to claim 14, wherein:

the main controller further comprises an identification circuit, and the identification circuit is configured to identify the lamp unit, which is physically connected to the main controller, from the combined lamp, and take the lamp unit, which is physically connected to the main controller, as the central node; and the address configuration circuit is further configured to: take the lamp unit that is taken as the central node as the reference, and configure the address information for the lamp units of the combined lamp according to the preset algorithm strategy and according to the connection relationship between the lamp units of the combined lamp.

16. The system according to claim 15, wherein:

the address configuration circuit is further configured to:

take a lamp unit that is physically connected to any one lamp unit of the lamp units of the combined lamp as a next-stage lamp unit of the any one lamp unit, and take the any one lamp unit as a previous-stage lamp unit of the lamp unit that is physically connected to the any one lamp unit;

assign corresponding address information to the lamp unit that is taken as the central node, and take the lamp unit that is taken as the central node as a previous-stage lamp unit to detect whether an IO interface of the previous-stage lamp unit is connected to a next-stage lamp unit, in a case where the IO interface of the previous-stage lamp unit is connected to the next-stage lamp unit, configure corresponding address information for the next-stage lamp unit that is connected to the previous-stage lamp unit according to the preset algorithm strategy and according address information of the previous-stage lamp unit; and continually take a lamp unit with address information that is configured latest as a previous-stage lamp unit, and configure corresponding address information for a next-stage lamp unit, which is connected to an IO interface of the previous-stage lamp unit with the address information that is configured latest, according to the preset algorithm strategy and according to the address information that is configured latest until all the lamp units of the combined lamp are configured to obtain address information.

17. The system according to claim 16, wherein the address configuration circuit is further configured to:

establish a coordinate system for the combined lamp, configure a coordinate value of the central node according to the coordinate system that is established, and record each lamp unit of the combined lamp as a node, take the central node as a previous-stage node, acquire an IO interface, which is connected to a next-stage node, of the previous-stage node, and determine a coordinate axial direction of the IO interface;

determine a node type and a node direction of the next-stage node according to the coordinate axial direction of the IO interface, which is connected to the next-stage node, of the previous-stage node, and determine a coordinate value of the next-stage node by combining with a coordinate value of the previous-stage node, the node type of the next-stage node, and the node direction of the next-stage node; and continually take a node with a coordinate value that is determined latest as a previous-stage node, determine a node type and a node direction of a next-stage node, which is connected to the previous-stage node, according to a coordinate axial direction of an IO interface, which is connected to the next-stage node, of the previous-stage node, and determine a coordinate value of the next-stage node in combination with the coordinate value that is determined latest until coordinate values of nodes corresponding to all the lamp units of the combined lamp are determined.

18. The system according to claim 17, wherein:

the address configuration circuit is further configured to set corresponding interface numbers for IO interfaces of any node, acquire an interface number of the IO interface, which is connected to the next-stage node, of the previous-stage node, determine the coordinate axial direction of the IO interface corresponding to the interface number, and determine the node type and the node direction of the next-stage node.

19. The system according to claim 17, wherein:

the address configuration circuit is further configured to set the coordinate system that is established to a rectangular coordinate system, wherein coordinate axes of the rectangular coordinate system comprise an x-axis and a y-axis;

a next-stage node, which is connected to an IO interface being in a positive direction of the x-axis, is a positive direction normal node, a node type of the next-stage node is a normal node, and a node direction of the next-stage node is the positive direction of the x-axis;

a next-stage node, which is connected to an IO interface being in a negative direction of the x-axis, is a negative direction normal node, a node type of the next-stage node is a normal node, and a node direction of the next-stage node is the negative direction of the x-axis;

a next-stage node, which is connected to an IO interface being in a positive direction of the y-axis is a positive direction turning point, a node type of the next-stage node is a turning point, and a node direction of the next-stage node is the positive direction of the y-axis; and a next-stage node, which is connected to an IO interface being in a negative direction of the y-axis, is a negative direction turning point, a node type of the next-stage node is a turning point, and a node direction of the next-stage node is the negative direction of the y-axis.

20. An electronic device, comprising:

a processor; and a memory configured to store computer executable instructions, wherein in a case where the computer executable instructions are executed, the executable instructions enable the processor to:

connect at least two lamp units of a combined lamp;

connect a main controller to any lamp unit of the combined lamp, wherein the main controller comprises an address configuration circuit, a parsing circuit, and a control circuit;

take a lamp unit of the at least two lamp units that is physically connected to the main controller as a reference, configure address information for lamp units of the combined lamp according to a preset algorithm strategy and according to a connection relationship between the lamp units of the combined lamp;

receive a control instruction that controls a light-emitting state of the combined lamp and carries at least one address information, and parse out the at least one address information carried in the control instruction; and generate a control signal corresponding the control instruction according to the control instruction, carry the at least one address information that is obtained by parsing in the control signal and sending the control signal to the combined lamp, and enable a lamp unit, which is matched with the at least one address information in the control signal, to utilize the control signal to control a light-emitting state of the lamp unit, which is matched with the at least one address information in the control signal, wherein each lamp unit of the combined lamp has at least two IO interfaces, wherein two adjacent lamp units of the combined lamp are physically connected to each other through an IO control line that is connected between two IO interfaces of the two adjacent lamp units, the main controller has at least one IO interface, wherein the main controller is physically connected to any lamp unit through an IO control line that is connected between an IO interface of the main controller and an IO interface of the any lamp unit; and wherein the address information for the lamp units of the combined lamp are configured by identifying a lamp unit physically connected to the main controller as a central node and a next-stage lamp unit of the central node.

* * * * *